US005304045A

United States Patent [19]

Hoshino et al.

[11] Patent Number: 5,304,045

[45] Date of Patent: Apr. 19, 1994

[54] CLOSED TYPE MOTOR-DRIVEN COMPRESSOR, A SCROLL COMPRESSOR AND A SCROLL LAP MACHINING END MILL

[75] Inventors: Nobutoshi Hoshino, Imaichi; Kazuo Ikeda, Tochigi; Kooichi Inaba, Tochigi; Shigeya Kawaminami, Tochigi; Atushi Shimada, Tochigi; Tatuya Wakana, Tochigi; Nobuo Abe, Tochigi; Kunio Fukami, Tochigi; Hidenari Takada, Tochigi; Masanori Wakaizumi, Tochigi; Mitsuaki Haneda; Keiji Taguchi, both of Ibaraki; Toshio Yamanaka, Yokohama; Tatuo Horie, Tochigi; Masami Masuda, Yokohama, all of Japan

[73] Assignee: Hitachi, Ltd., Tokyo, Japan

[21] Appl. No.: 942,022

[22] Filed: Sep. 8, 1992

[30] Foreign Application Priority Data

| | | | |
|---|---|---|---|
| Oct. 3, 1991 | [JP] | Japan | 3-255625 |
| Jan. 10, 1992 | [JP] | Japan | 4-003129 |
| Jan. 13, 1992 | [JP] | Japan | 4-003885 |

[51] Int. Cl.[5] ..... F04C 29/02

[52] U.S. Cl. ..... 417/372; 418/55.6; 418/95; 418/DIG. 1

[58] Field of Search ..... 417/372; 418/55.6, 95, 418/DIG. 1

[56] References Cited

U.S. PATENT DOCUMENTS

| | | | |
|---|---|---|---|
| 4,997,349 | 3/1991 | Richardson | 418/55.6 X |

FOREIGN PATENT DOCUMENTS

| | | | |
|---|---|---|---|
| 160587 | 9/1983 | Japan . | |
| 170774 | 12/1987 | Japan . | |
| 32190 | 2/1988 | Japan | 418/55.6 |
| 192985 | 8/1988 | Japan | 418/DIG. 1 |
| 187388 | 7/1989 | Japan . | |

*Primary Examiner*—Richard E. Gluck

*Attorney, Agent, or Firm*—Antonelli, Terry, Stout & Kraus

[57] ABSTRACT

A closed type motor-driven compressor includes a motor accommodated in a closed container and a compression mechanism connected through a crank shaft to the motor. A shielding member having a cylindrical portion substantially concentric with the axis of the compression mechanism is disposed between the motor and the compression mechanism. This shielding member defines a shielding air space between the motor and the compression mechanism for preventing a permeation of a lubricating oil. An inlet of a discharge pipe of the closed type motor-driven compressor is positioned inwardly of this shielding air space.

5 Claims, 16 Drawing Sheets

CLOSED TYPE MOTOR-DRIVEN COMPRESSOR, A SCROLL COMPRESSOR AND A SCROLL LAP MACHINING END MILL

BACKGROUND OF THE INVENTION

1. Field of the Invention

The present invention relates to a closed type motor-driven compressor and, more particularly, to a closed type motor-driven compressor employed for air conditioning or refrigerating an suitable for improving a performance of a refrigerating cycle and securing a reliability of the compressor.

Furthermore, the present invention is directed to a closed type motor-driven compressor based on a double-bearing structure intended to avoid a concentration of sliding load.

Moreover, the present invention is concerned with a scroll compressor suitable mainly for improving strength of wraps for forming a pump and obtaining a high air tightness. Additionally, the present invention relates to an end mill for machining wraps of a fixed scroll and an orbiting scroll in the scroll compressor.

2. Description of the Prior Art

In the scroll compressor shown in FIG. 4, a compression mechanism 7 is accommodated in an upper portion of the closed container 9, while a motor 8 is accommodated in the lower portion thereof. Contained in the closed container 9 is a lubricating oil for lubricating sliding portions of the compression mechanism 7.

The compression mechanism 7 includes a fixed scroll 7*a*, an orbiting scroll 7*b*, a frame 14, a crankshaft 11, an Oldham's ring 7*c*. The motor 8 has a stator 8*a* and a rotor 8*b*. The stator 8*a* is fixed by shrinkage-fitting in the closed container 9. The rotor 8*b* is fixed by press-fitting to the crankshaft 11.

An outer peripheral part of the frame 14 is fixed to the 10 closed container 9 and provided with a bearing for the crankshaft 11. The fixed scroll 7*a* is fastened to the frame 14.

The fixed scroll 7*a* and the orbiting scroll 7*b* respectively have spiral wraps extending from end plates. The respective wraps mesh with each other, thus defining compression chambers.

An eccentric part of the crankshaft 11 is rotatably received in a boss of the orbiting scroll 7*b*. A rotation of the scroll 7*b* about its own axis is prevented by the Oldham's ring 7*c*, whereby revolving action is given. The arrangement is such that a refrigerant gas, suctioned for an inlet (not shown) of the fixed scroll 7*a* is gradually compressed in the compression chambers upon rotation of the orbiting scroll 7*b*.

The lubricating oil 10 is supplied to a bearing part 12*a*, crank part 12*b*, etc. with rotations of the crankshaft 11 connected directly to the rotor 8*b*. The lubricating oil is thereafter discharged through a discharge port 13 and returned to the closed container bottom part 9*a*. Some of the lubricating oil, however, is atomized due to an influence of stirring or the like of the rotor 8*b* of the motor module. The refrigerated gas enters the compression mechanism from a suction pipe 4*b* and is compressed therein. The compressed gas is exhausted into the closed container 9 from the discharge port 13 and fed together with the atomized lubricating oil to the refrigerating cycle via discharge pipe 4*a*.

The prior art refrigerating cycle illustrated in FIG. 5 includes a compressor 1, heat exchangers 2*a*, 2*b*, an expansion member 3 and a piping system 4 for connecting these components, thereby circulating the refrigerant. The oil separator 5 separates the atomized lubricating oil discharged together with the refrigerant from the discharge pipe 4*a* of the compressor 1. The oil separator 5 is equipped with a bypass line 6 for quickly returning only the lubricating oil component for the compressor (interior). With this arrangement, the reliability of the compressor is improved by preventing a deficiency of lubricating oil within the compressor. At the same time, the lubricating oil is prevented from circulating through the heat exchangers, thereby preventing a drop in efficiency of the refrigerating cycle as well as preventing a decrease in heat transfer coefficient due to an adhesion of lubricating oil to an internal wall of the heat exchanger pipe.

The following problems are inherent to the prior art constructions. Provided outside the compressor is an oil separator circuit for quickly returning to the compressor the lubricating oil discharged from the compressor discharge pipe to the refrigerating cycle. The structure of the refrigerating cycle becomes complicated and is increased in size, resulting in an increase of the total cost of the system. Then, the following measures are taken in some cases, the oil separator circuit is not provided, and, instead, as illustrated in FIG. 6, a discharge pipe 4A is provided in a vicinity of the center of the container. A quantity of the lubricating oil is reduced by increasing the refrigerant component to be fed outside the compressor as in the case of centrifugally separating the lubricating component having a large density caused by a swirling flow due to the rotor 8*b* of the motor.

In this case, the centrifugally separated lubricating oil is re-atomized by the rotor of the motor and, hence, a gas-liquid separating ability is insufficient. The lubricating oil within the compressor becomes sufficient, resulting in a reduction in the reliability of the compressor.

Further, a circulating of the lubricating oil to the heat exchangers is caused. The heat transfer coefficient is reduced because the adhesion of the lubricating oil to the inner walls of the pipes of the heat exchangers and, therefore, the efficiency of the refrigerating cycle is decreased. Needed further is an air space for arranging the discharge pipe to the upper portion of the rotor. This leads to an increase in the overall size of the compressor.

Another example of a gas-liquid separation within a compressor is disclosed in Japanese Unexamined Patent Publication No. 58-160587. Based on this technical approach, a gas-liquid separation blade is provided on the upper portion of the rotor of the motor. Provided further on the upper portion of the motor is a partition plate for substantially entirely partitioning the motor and the compression mechanism. A discharge pipe is arranged to communicate with the air space in the upper portion of the partition plate. An outer periphery of the partition plate contacts with an inner wall of the closed container, while an inner periphery thereof contacts with a bearing boss. In this last mentioned prior art construction, the internal structure of the compressor becomes complicated and the costs increased. In, for example, Japanese Unexamined Patent Publication No. 1-170774, an auxiliary bearing in the conventional double-bearing-structured closed type motor-driven compressor is proposed wherein a typical ball bearing, having spherical members rotatably disposed between an inner ring and an outer ring, is press-fitted into a boss hole of a support leg formed by casting or forging, etc.

The mounting structure of the auxiliary bearing of the conventional closed type motor-driven compressor described above, however, has the following disadvantages.

Namely, the cast or forged member is poor in terms of the forming accuracy. If such a cast or forged member exhibiting the poor forming accuracy is employed as a constructive material of the support leg, equipment and expenditure for working these materials are required. This contributes to a rise in the total manufacturing costs.

Additionally, for securing an accurate center of the auxiliary bearing and the casing minor diameter which requires precise centering during an assembly, it is necessary to, as a matter of course, secure a concentricity between an annular major diameter of the support leg and the boss hole into which the ball bearing is press-fitted. The casing decreases in rigidity, and when fitting the stator of the motor, a deformation is caused. In this case also, however, it is necessary that the casing inner surface be worked to enhance the accuracy of the casing combined with the support leg. There are many disadvantages in terms of the manufacturing costs including the assembly.

Additionally, in the conventional closed type motor-driven compressor a ball roller bearing is employed as an auxiliary bearing. In products such as a domestic room air-conditioner which utilizes the foregoing closed type motor-driven compressor, an operating noise is perceived as an important factor for determining the quality thereof. It is impossible in the roller bearing to avoid a generation of tap noises attributed to the rolling of the ball bearing.

A further conventional scroll compressor is disclosed in, for example, Japanese Unexamined Patent Publication No. 1-187388, wherein wraps of the fixed and orbiting scrolls have inner and outer surfaces which basically extend from the end plates. To illustrate in more detail, the wraps commonly take the configuration shown in FIG. 22 wherein the compressor includes a fixed scroll 201, an orbiting scroll 202, wraps 203*a*, 203*b*, end plates 204*a*, 204*b*, wrap root parts 205*a*, 205*b*, stepped parts 224*a*, 224*b*, wrap tip parts 206*a*, 206*b*, chamfered parts 225*a*, 225*b*, wrap side surfaces 207*a*, 207*b*, wrap bottom surfaces 209*c*, 209*b*, and an air gap 226.

As shown in FIG. 22, the wrap root parts 205*a*, 205*b* of the wraps 203*a*, 203*b* are provided with small stepped parts 224*a*, 224*b* in order to enhance the mechanical strength of the wraps 203*a*, 203*b*. Furthermore, the wrap tip parts 206*a*, 206*b* are formed with the chamfered parts 225*a*, 225*b* which do not contact the stepped parts 224*a*, 224*b* when the fixed scroll 201 is assembled with the orbiting scroll 202.

When the orbiting scroll 202 orbits about a central axis (not shown), the wraps 203*b* of the orbiting scroll 202 move near to or away from the wrap 203*a* of the fixed scroll 201. A refrigerant gas between the wraps 203*a*, 203*b* is thereby compressed. During such operation, the arrangement is such that the refrigerant gas does not leak from the air space between the wraps 203*a*, 203*b*. The spacing between the wrap tip part 206*a* and the wrap bottom surface 209*b*, between the wrap tip part 206*b* and the wrap bottom surfaces 209*a*, 209*b* are minimized. Moreover, when the wraps 203*a*, 203*b* approach each other, the distance between the stepped part 224*a* and the chamfered part 225*b* and between the stepped part 224*b* and the chamfered part 225*a* are minimized so that oil films of the refrigerating machine oil mixed in the refrigerant gas are formed between the wraps 203*a*, 203*b*.

The stepped parts 224*a*, 224*b* at the root parts 205*a*, 205*b* are normally formed when machining the wraps with an end mill. More specifically, the machining of the wraps 203*a*, 203*b* is the same and, therefore, the respective portions will be shown by removing the letters a, b from the reference numerals. As illustrated in FIG. 23, in a workpiece previously formed with a wrap tip part 206 and a chamfered part 225, a wrap side surface 207 is machined by the major-diameter part of the end mill 227 (FIG. 23A). Thereafter, the wrap bottom surface 209, i.e., the upper surface of the end plate 204 is machined by the tip of the end mill 227 (FIG. 23B). The wrap 203 is thus machine by the two separate steps. However, the major diameter of the end mill 227 is set slightly smaller than the minimum spacing between the spiral wrap 203 and the end plate 204. The stepped part 224 is thereby formed simultaneously when machining the upper surface of the end plate 204 shown in FIG. 23B.

As shown in FIG. 24A, in a workpiece 229 of fixed scroll 201 or a rotary scroll 202, formed substantially in predetermined dimensions, the surface of the wrap tip part 206 is premachined. Machined by a side surface machining end mill 228 is a workpiece side surface 230 of a spiral projection which will turn out a wrap of the workpiece 229. A wrap 203 is formed so that a thick dimension of this projection is set in a predetermined dimension. Thereafter, as shown in FIG. 24B, the tip edge of this projection is cut to form an obliquely chamfered part 225 by a chamfering cutter 231.

The conventional scroll wrap machining end mill is, as illustrated in FIG. 25A, made of a typical tool steel or super hard material and has a cutting edge 233 assuming such a configuration that the tip is accurately ground. Alternatively, as depicted in FIG. 25B, a coating 234 is applied to the entire surface of a base metal 232 of the end mill. This coating 234 is composed of diamond exhibiting an extremely high hardness and high melting point or a crystal of carbides of a variety of metals.

In the scroll compressor including a combination of the fixed scroll 201 and the orbiting scroll 202 having the wraps 203*a*, 203*b* formed by the above-described machining, the tips of the respective wraps 203*b*, 203*a* are formed obliquely with the chamfered parts 225*b*, 225*a* so as not to impinge of the stepped parts 224*a*, 224*b*. Therefore, even when the wraps 203*a*, 203*b* approach each other, the air gaps 226 serving as linear seals formed between the stepped part 224*a* and the chamfered part 225*b* and between the stepped part 224*a* and the chamfered part 225*b* are increased. Generally, an oil film of refrigerating machine contained in the refrigerant gas is formed in such an air gap 226. The refrigerant gas does not leak out of the above-mentioned air gap 226 due to a sealing effect of the oil. As shown above, however, if the air gap 226 is large and when the wraps 203, 203*b* approach each other, a pressure of the refrigerant gas therebetween is large. Hence, the oil film of the refrigerating machine oil therein is easy to break and a sealing effect cannot be obtained. For this reason, during normal operation of the compressor, the refrigerant gas which is continuously compressed leaks out of the air gap where the oil film has been broken, thereby causing a performance reduction. The electric power consumed for operation is increased and, therefore, a problem arises in terms of saving energy.

Based on the above-described working methods, the wrap side surface and the chamfered part are machined by the separate steps and, therefore, the manufacturing time, as a matter of course, is increased and production efficiency is reduced. Additionally, if machining is conducted in this way by the separate steps, and when shifting from the machining step of the wrap side surface to the machining step of the chamfered part is carried out, reattaching a tool is required. In working of a complicated configuration such as a non-curved shape, there may be easily caused positional offset between the side surface machining end mill 228 for machining the workpiece side surface 230 and the chamfering cutter 231 for machining the chamfered part 225 in FIG. 24 and, consequently, a high dimensional machining accuracy cannot be realized.

The conventional scroll wrap machining end mill 235 illustrated in FIG. 25 is flat cutter member, the tip of which is sharp thereby resulting in a chipping readily taking place. Further, in the coating end mill, the coating 234 involves the use of diamond or crystal of carbides of various metals exhibiting extremely high hardness and high melting point. These materials have different mechanical and chemical properties from that of the end mill base metal 232, so that the end mill base metal 232 is therefore difficult to join with the coating. Previous studies have been carried out in order to determine the effects of surface treatments for promoting joining of coating to the end mill base metal 232. However, such studies have found inevitable slight deviations in temperature, atmosphere, etc. during the surface treatment and coating process. Thus, the joining strength between the end mill base metal 232 and the coating 234 is quite unstable.

As a result, when a workpiece is machined by use of an end mill base metal described above, the cutting edge 233 is sharp and is therefore brought into a point-contact with the workpiece. Bi-directional cutting stress from the side and bottom surfaces of this cutting edge 233 is applied extremely largely on the tip of the cutting edge 233. Consequently, this cutting stress extremely largely acts thereon, with the result that the coating 234 is peeled. Causes is a rapid wear of the tip of the cutting edge 233 at the initial working stage. It is impossible to secure a predetermined cutting accuracy and cutting distance.

SUMMARY OF THE INVENTION

It is a primary object of the present invention to avoid the problems encountered in the prior art and to provide a closed type motor-driven compressor which is compact, requires low costs and is capable of enhancing both an efficiency of heat exchangers in a refrigerating cycle by reducing an amount of lubricating oil discharged through a discharge pipe of the compressor to the refrigerating cycle and a reliability of the compressor by securing the oil quantity within the compressor. According to the present invention, a closed type motor-driven compressor is provided which comprises a closed container, a motor accommodated in the closed container, a compression means in the container, a crankshaft for connecting the motor to the compression means, and a discharge pipe having an inlet positioned in the closed container and extending outwardly from the closed container. A lubricating oil is contained in the closed container, wherein a shielding member includes a cylindrical portion and is mounted between the compression means and the motor. The cylindrical portion of the shielding member has an axis substantially concentric with an axis of the compression means, with a shielding air space for preventing a permeation of the lubricating oil being formed between the compression mechanism and the motor, and the inlet of the discharge pipe is positioned in the shielding air space. With this construction, it is difficult for the atomized oil mist to flow into the cylindrical portion of the shielding member from outside thereof. The inlet of the discharge pipe is disposed in the interior of the cylindrical portion of the shielding member. It is thus possible to secure the reliability of the compressor by preventing the lubricating oil component from being discharged through the discharge pipe to the refrigerating cycle and thus quickly returning it to the interior of the compressor. It is also feasible to simplify or miniaturize the structure by eliminating the oil separator circuit from the refrigerating cycle and reduce the manufacturing costs.

It is another object of the present invention to solve the problems peculiar to the prior art disclosed in Japanese Unexamined Patent Publication No. 1-170774 and provide a closed type motor-driven compressor including an auxiliary bearing capable of simplifying the working and assembling processes with a simple structure and at low costs, wherein centering can also be easily effected.

According to another aspect of the present invention, a closed type motor-driven compressor includes a closed container having a cylindrical casing and cover members welded to upper and lower ends of the casing, with a compressor body being accommodated in the closed container and a motor disposed in the container. A rotary shaft connects the compressor body to the motor, with a main bearing for the rotary shaft being disposed in the vicinity of the compressor body, and with an auxiliary bearing for the rotary shaft being disposed opposite to the main bearing with the motor interposed therebetween. A support leg made of a steel plate, and fabricated by plastic working, includes an annular wall joined to an inner surface of the casing and a radial part extending inwardly from the annular wall and having formed therein a central hole for the rotary shaft. The support leg is fixed to the inner surface of the casing in such a manner that the annular wall is press-fitted and welded to the casing, and the auxiliary bearing is centered with respect to the rotary shaft and fixed by welding to the radial part.

With this construction, the support leg is formed by high-accuracy plastic working and therefore does not require machining in the post-process as compared with the support leg formed by poor-accuracy casting or forging needed in the prior art compressor. Hence, the support leg to be used can be manufactured in a short time and at a high accuracy and low cost. Further, since the auxiliary bearing is centered with respect to the rotary shaft and is welded to the support leg, even if there is an offset between the center of the casing and the center of the rotary shaft depending upon combinations of related parts in the mounting of the compressor body and the support leg into the casing, the auxiliary bearing acts as a smooth roller bearing for the rotary shaft to greatly reduce the production of noise.

It is still another object of the present invention to eliminate the problems associated with the prior art disclosed in Japanese Unexamined Patent Publication No. 1-187388 and to provide a scroll compressor capable of preventing a leakage of a refrigerating gas from between a fixed scroll and an orbiting scroll, exhibiting a high efficiency and reducing the electric power consumed for operation.

According to still another aspect of the present invention, a scroll compressor includes a fixed scroll having a first disk-like end plate and a first spiral wrap extending from the end plate, an orbiting scroll having a second disk-like end plate and a second spiral wrap extending from the end plate, with a gas being compressed by orbiting motion of the orbiting scroll. First chamfered parts are formed in respective wrap route portions of the first spiral wrap and the second spiral wrap, with second chamfered portions, slightly smaller than the first chamfered parts, being formed in the respective wrap tip parts of the second and first spiral wraps to confront the first chamfered parts. A width of a tip surface of each of the wraps is less than 5% of a thickness of the wrap.

Formed in the scroll compressor of the present invention are small and uniform spacings between the route parts of the wraps of the fixed scroll and the respective chamfered parts of the tip parts of the wraps of the orbiting scroll and between the tip parts of the wraps of the fixed scroll and the respective chamfered parts of the root parts of the wraps of the orbiting scroll. Oil films of the refrigerator machine oils are therefore easily formed in the uniform spacings. Accordingly, the gas leakage from the uniform spacing can be reduced to a minimum. Consequently, the performance of the compressor is improved and the operating electric power consumption can be reduced. Furthermore, the width of the chamfered part at the tip of the wrap is set less than 5% of the wrap thickness. Hence, the surface width of the wrap can be set large enough to prevent the gas leakage. Moreover, it is feasible to enhance the working accuracy and working efficiency of the fixed and orbiting scrolls. The reliability of the compressor can be increased and a reduction in the price is also attainable.

It is a further object of the present invention to provide a scroll wrap machining end mill capable of reducing a working time of wraps of fixed and orbiting scrolls and of machining the wraps at a high accuracy.

According to a further aspect of the present invention, a scroll wrap machining end mill for machining wraps so that the chamfered parts are formed as tip parts of a fixed scroll and an orbiting scroll includes first cutting edges having a chamfering cutting edges having configuration corresponding to configurations of the chamfered parts and disposed at stepped portions and side surface machining cutting edges extending from the chamfering cutting edges via cut run-offs to the tips, and second cutting edges formed as side surface machining cutting edges and extending more upwardly than the chamfering cutting edges.

In the scroll wrap machining end mill of this invention, the tip parts of the wraps of the scrolls, formed substantially of predetermined dimensions, are cut by the chamfering cutting edge, thus forming the predetermined chamfered parts at the tip parts thereof. Further, the side surfaces of the wraps are cut by the side surface machining cutting edge. The wrap side surfaces are thus formed to set the wrap thickness in a predetermined dimension. In this manner, the wrap side surfaces and the chamfered parts of the tip parts of the wraps are simultaneously formed. Besides, the positional relationship between the chamfered parts and the wrap side surfaces is accurately set. Additionally, the cut chips are removed through the cutting run-offs. The chamfered parts and the wrap side surfaces are therefore accurately machined.

Further, the scroll wrap machining end mill of this invention is capable of simultaneously machining different parts of the wraps of the fixed and orbiting scrolls and, as a result, realizing both a reduction in the working time and an improvement in the working efficiency. Moreover, this leads to enhancements in terms of the positional relationship of the worked parts and configurational/dimensional accuracies as well.

It is a still further object of the present invention to provide a scroll wrap machining end mill capable of constantly securing a desired cutting accuracy and cutting distance.

According to a still further aspect of the present invention, there is provided a scroll wrap machining end mill in which a coating composed of a super hard material is applied to the surface of a precisely finished end mill base metal, wherein a chamfered part having an obtuse-angled configuration is formed at the tip of a cutting edge of the end mill base metal, and the coating is applied to the surface of the end mill base metal including the chamfered part.

In the scroll warp machining end mill of the invention, the cutting edge of the end mill base metal has the chamfered part and therefore locally assumes an obtuse-angled configuration. The workpiece end of the cutting edge are thereby put into a line-contact state. As compared with the conventional point-contact state where the load stress approaches infinity, the bid-directional cutting stress from the side surface and the bottom surface of the cutting edge is remarkably reduced. Consequently, this prevents separation of the coating from the end mill base metal. A rapid wear of the cutting edge at the initial cutting stage can be avoided. It is feasible to stabilize the machining accuracy and increase a life-span of the tool, thereby improving the work efficiency.

Other objects, features and advantages of the present invention will become more apparent from the following description.

DESCRIPTION OF PREFERRED EMBODIMENTS

Figure 1:
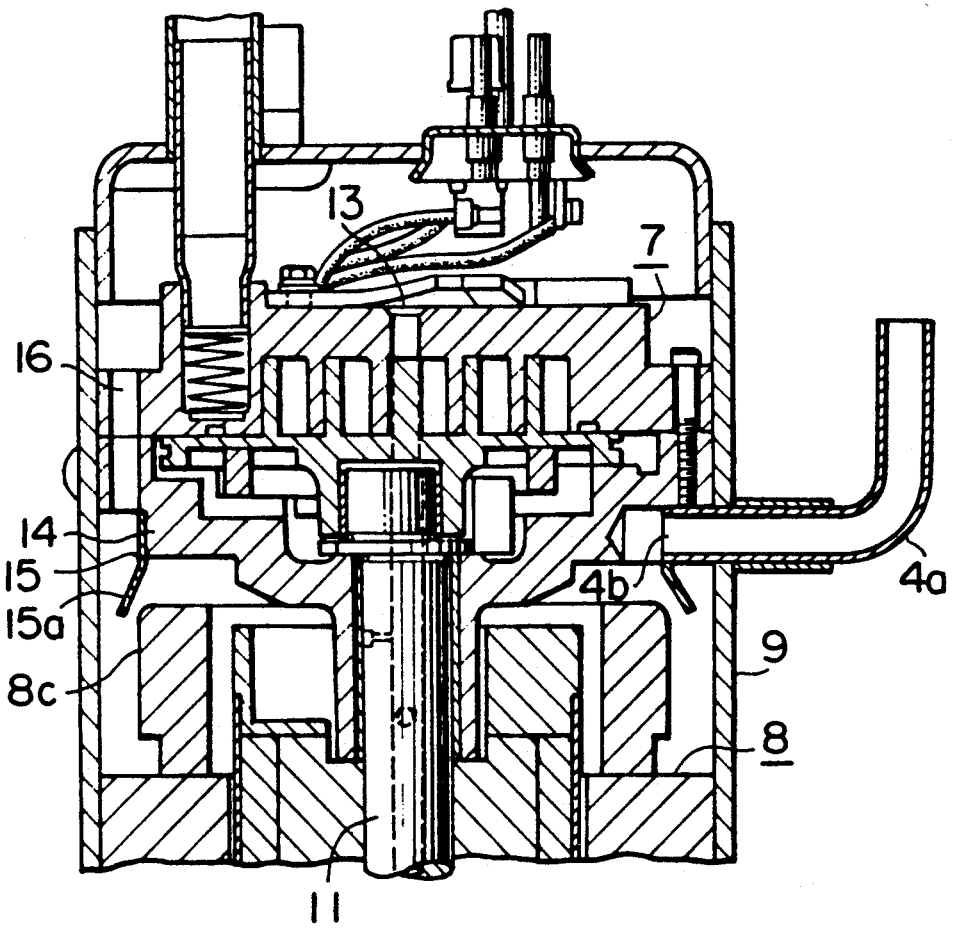
FIG. 1 is a sectional view illustrating a portion of one embodiment of a closed type scroll compressor of the present invention.

Referring now to the drawings wherein like reference numerals are used throughout the various views to designate like parts and, more particularly, to FIG. 1, according to the present invention, a shielding ring 15, composed of sheet metal, is disposed between a frame 14 serving as a part of a compression mechanism 7 and a stator coil end 8*c* serving as a part of a motor. An inlet of a discharge pipe 4*a* is disposed inwardly of the shielding ring 15.

A shielding ring 15 is constructed such that a tip of the ring is curled in a flare-like configuration and the principle portion is formed as a cylindrical portion concentric with an axis of the compressor. The cylindrical portion is mounted on an outer peripheral part of the frame 14. An insulating distance from the stator coil end 8*c* is secured by the flare-like curled portion 15*a*.

A lubricating oil, discharged together with a gas discharged from a discharge port 13, is in the form of an atomized oil. The atomized oil passes through the frame 14 of the compression mechanism 7 and the notched groove 16 formed in the outer periphery of a fixed scroll and dropped down to a motor chamber. At this time, it is difficult for the atomized oil to flow into the interior of the shielding ring 15 from outside thereof due to the presence of the shielding ring 15. A density of the atomized oil can thereby be held low. Because the inlet 4*b* of the discharge pipe 4*a* is disposed inwardly of the shielding ring 15, it is possible to secure a reliability of the compressor by considerably reducing the lubricating oil discharged to the refrigerating cycle through the discharge pipe 4*a*.

Further, a gas-liquid separating means within the compressor is simply constructed. It is also feasible to attain simplification, miniaturization and a reduction in costs by eliminating an oil separator circuit from the refrigerating cycle.

Figure 2:
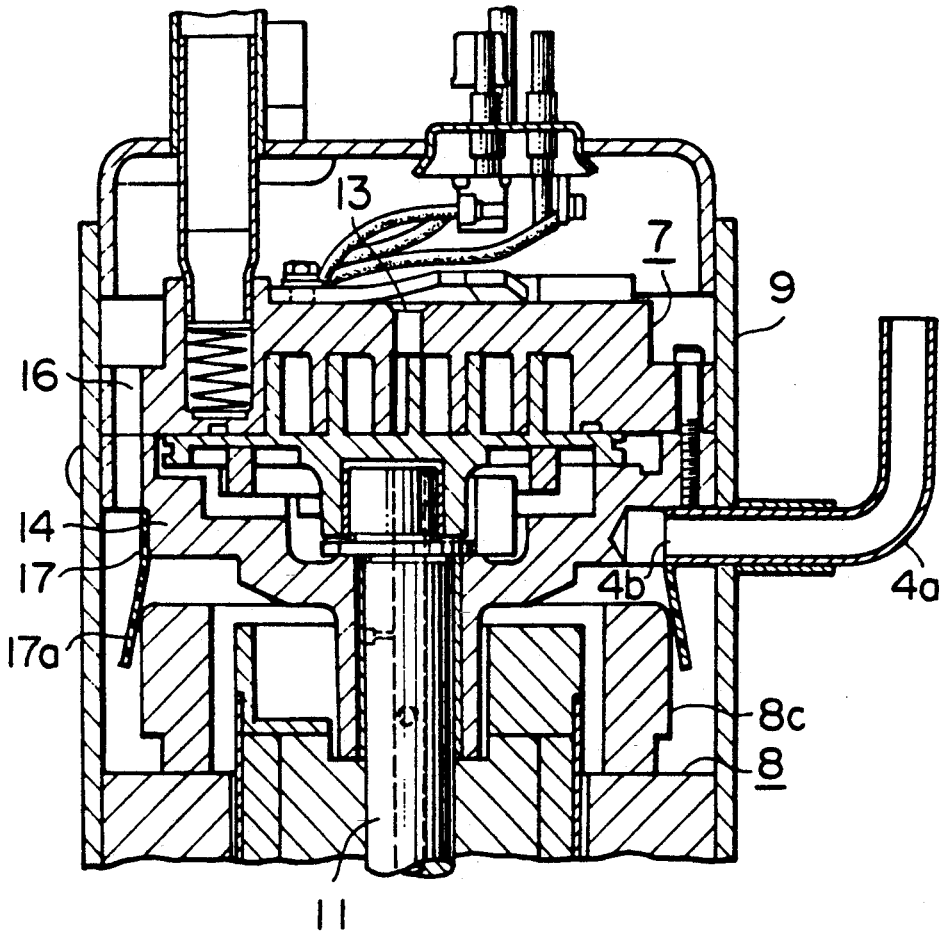
FIG. 2 is a sectional view showing a portion of another embodiment of the closed type scroll compressor of the present invention.

In the embodiment of FIG. 2 a shielding ring 17 having an electrically insulating property is disposed between the frame 14 of the compression mechanism 7 and the stator coil end 8*c* of the motor. The inlet 4*b* of the discharge pipe 4*a* is disposed inwardly of the shielding ring 17.

The shielding ring 17 is composed of a material exhibiting the electrically insulating property and constructed such that the tip of the ring is curled in the flare-like configuration and the principle portion is formed as a cylindrical portion concentric with the axis of the compressor. The cylindrical portion is mounted on the outer peripheral part of the frame 14. The flare-like curled portion 17*a* is positioned in close proximity with the stator coil end 8*c*.

In accordance with the embodiment of FIG. 2, the shielding ring 17 is composed of a material having the electrically insulating property and it is therefore possible to further enhance an effect of the shielding ring because of the fact that a gap between the shielding ring 17 and the stator coil end 8*c* can be sufficiently reduced. Hence, the lubricating oil discharged together with the gas discharged from the discharge port 13 is the atomized oil. The atomized oil passes through the notched groove 16 formed in the outer periphery of the compressor mechanism 7 and drops down to the motor chamber. On this occasion, less atomized oil flows into the interior of the shielding ring from outside thereof than in the embodiment of FIG. I. The density of the atomized oil can thereby be held low. Hence, it is more feasible to prevent the lubricating oil from being discharged to the refrigerating cycle to ensure that the lubricating oil is supplied to the compression mechanism.

Figure 3:
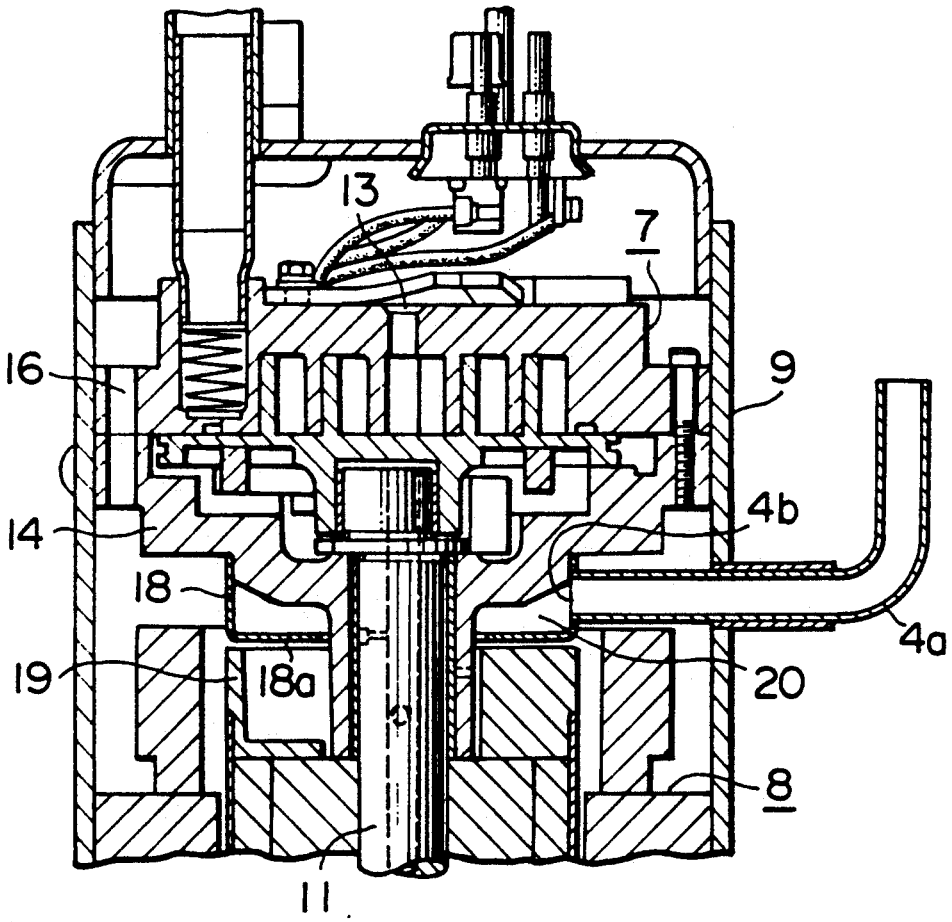
FIG. 3 is a sectional view depicting a portion of yet another embodiment of the closed type scroll compressor of the present invention.
Figure 4:
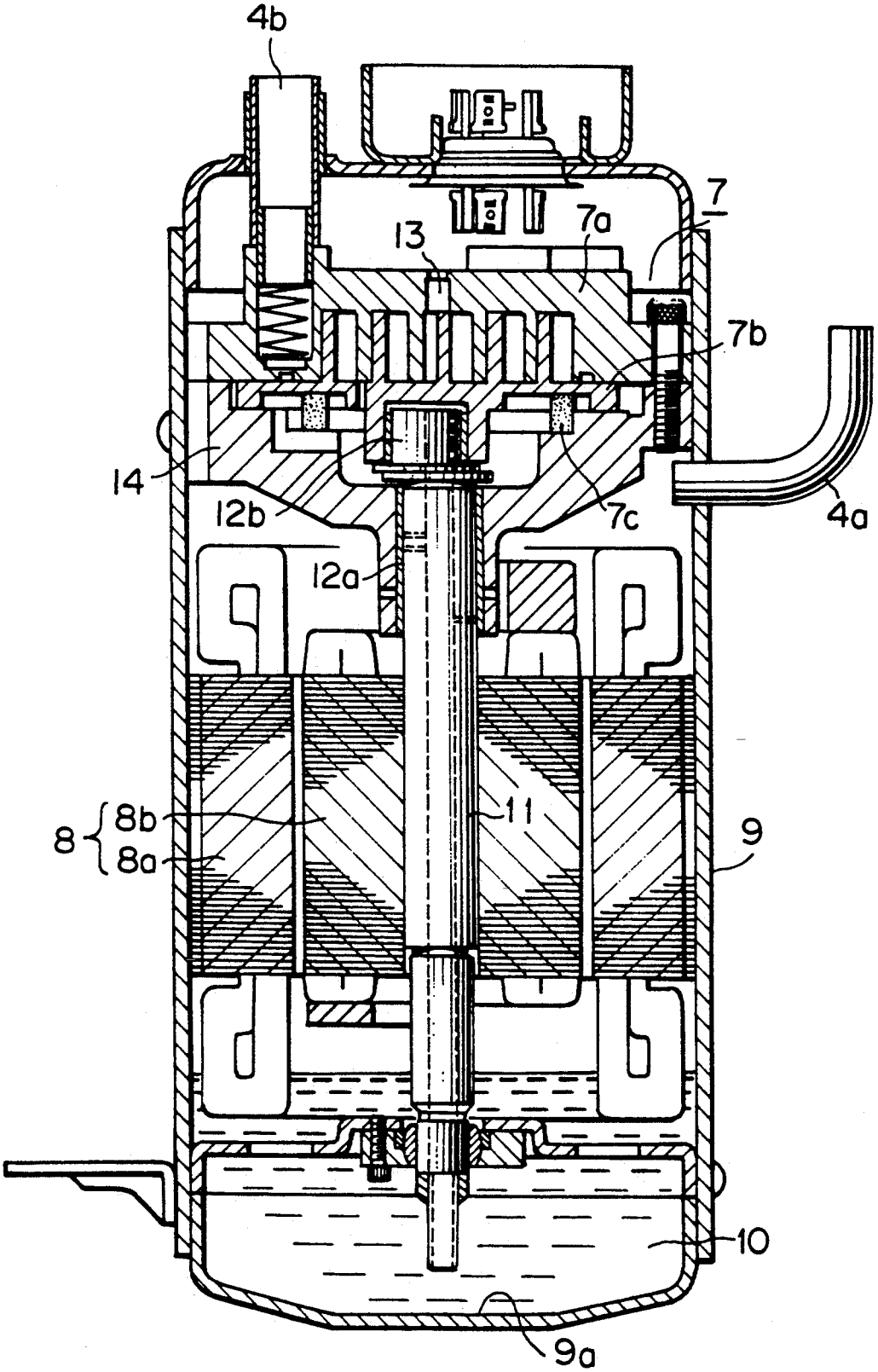
FIG. 4 PRIOR ART
FIG. 4 is a vertical-sectional view illustrating the conventional closed type scroll compressor.
Figure 5:
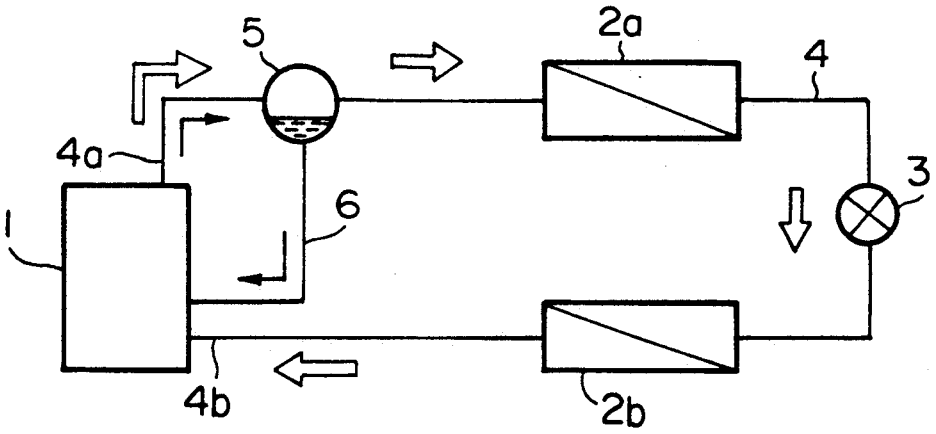
FIG. 5 PRIOR ART
FIG. 5 is a schematic view of a refrigerating cycle including a conventional oil separator.
Figure 6:
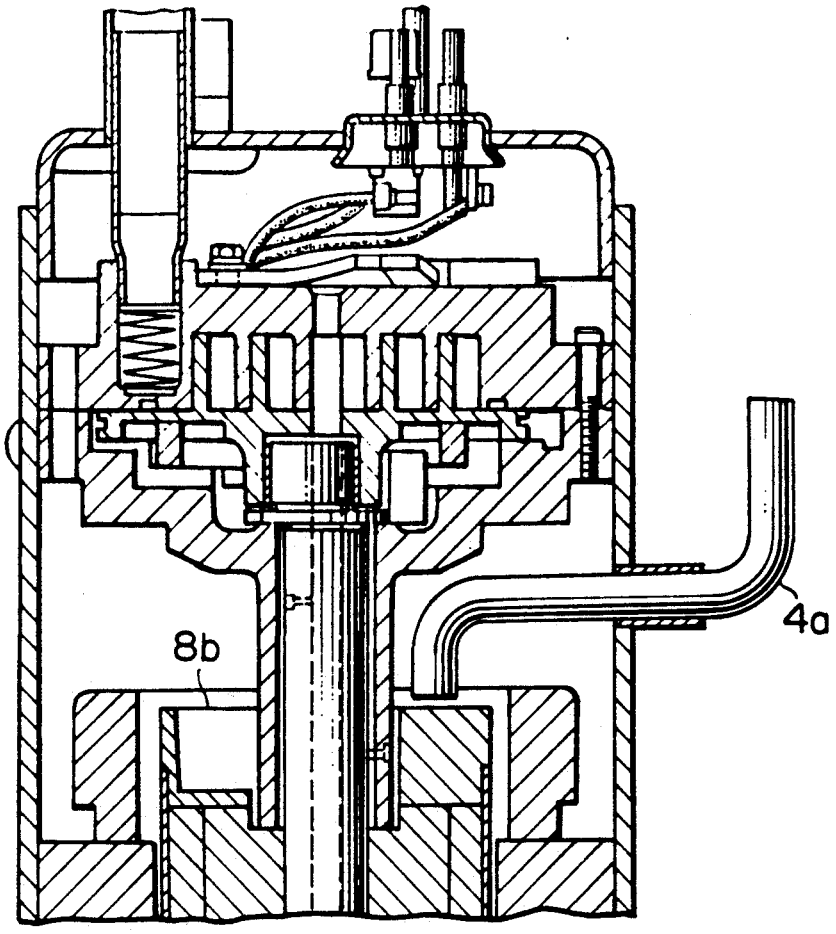
FIG. 6 PRIOR ART
FIG. 6 is a sectional view showing one example of a discharge pipe of the conventional closed type scroll compressor.

In the embodiment of FIG. 3, a shield ring 18 is disposed between the frame of the compression mechanism 7 and a rotor end ring 19 of the motor. The principle portion of the shielding ring 18 is formed as a cylindrical portion concentric to the axis of the compressor. A bottom surface part 18*a* of the shielding ring 18 is mounted in a vicinity of the rotor end ring 9. A small air space 20 is defined by the frame 14 and the shielding ring 18. The inlet 4*b* of the discharge pipe 4*a* is disposed in the interior of the small air space 20.

In accordance with the embodiment of FIG. 3, the lubricating oil discharged together with the gas discharged from the discharge port 13 is atomized oil. The atomized oil passes through the notched groove 16 formed in the outer periphery of the compression mechanism 7 and drops down to the motor chamber. Thereafter, very little atomized oil flows into the small air space 20 because of the narrow gap between the rotor end ring 19 which is rotating at a high speed and the shielding ring bottom surface part 18*a*. The density of the atomized oil can thereby be held low. The inlet 4*b* of the discharge pipe 4*a* is disposed inwardly of the shielding ring 18, i.e., in the small air space 20. It is, therefore, possible to considerably reduce the lubricating oil discharged to the refrigerating cycle through the discharge pipe 4*a* and also secure the reliability of the compressor.

Further, the gas-liquid separating means within the compressor is simply constructed. It is also feasible to attain the simplification, the miniaturization, and the reduction in costs by eliminating the oil separator circuit from the refrigerating cycle.

Note that the embodiments discussed above are examples of the closed type scroll compressor. The present invention is not, however, limited to the scroll compressor but may be, as a matter of course, applicable to other closed type motor-driven compressors, e.g., a closed type rotary compressor.

As described in detail, according to the present invention, it is possible to provide the closed type motor-driven compressor which is compact, requires low costs and is capable of enhancing both an efficiency of a heat exchanger in the refrigerating cycle and the reliability of the compressor by holding the oil quantity within the compressor.

Figure 7:
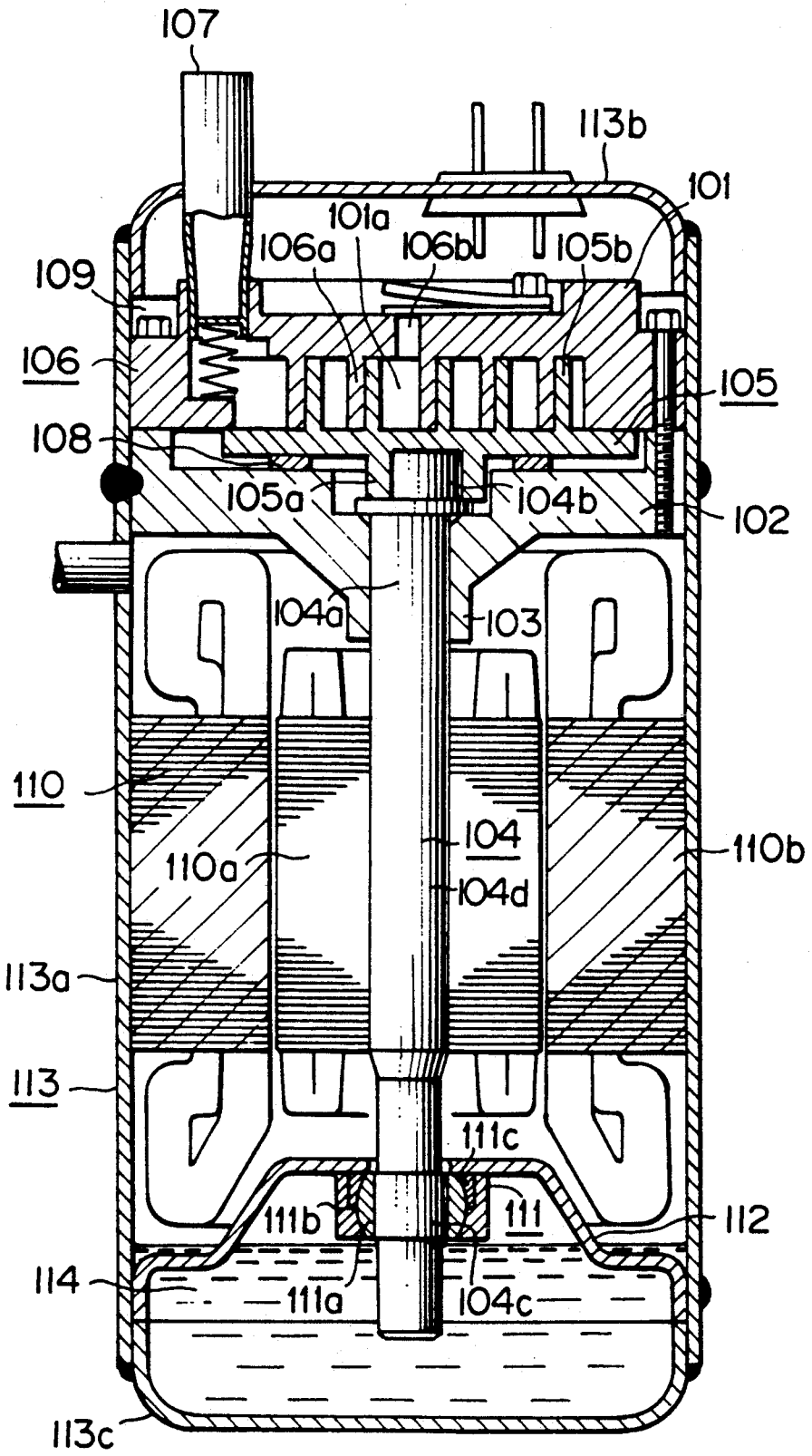
FIG. 7 is a vertical-sectional view showing a further embodiment of the closed type motor-driven compressor according to the present invention.

A closed type motor-driven compressor according to the present invention, as shown in FIG. 7, includes a compressor body 101, a compression chamber 101*a*, a frame 102, a main bearing 103, a rotary shaft 104, a main shaft part 104*a*, an eccentric part 104*b*, an auxiliary shaft part 104*c*, an orbiting scroll 105, a boss 104*a*, a wrap 105*b*, a fixed scroll 106, a wrap 106*a*, a discharge port 106*b*, a suction pipe 107, an Oldham's ring 108, a bolt 109, a motor 110, a rotor 110*a*, a stator 110*b*, an auxiliary bearing 111, a spherical bearing 111*a*, an outer ring 111*b*, a support leg 112, of the auxiliary bearing, a closed container 113, a casing 113*a*, a cover member 113*b*, a bottom cover member 113*c*, and a lubricating oil 114.

As shown in FIG. 7, the closed container 113 is constructed such that the cover member 113*b* is welded to one end of the casing 113*a*, while the bottom cover member 113*c* is welded to the other end thereof. In this closed container 113, the motor 110 is connected through a rotary shaft 104 to the compressor body 101. This rotary shaft 104 includes the main shaft part 104*a* and the eccentric part 104*b*. The central portion of the main shaft part 104*a* is press fitted or shrinkage-fitted in the rotor 110*a* of the motor 110. The stator 110*b* of the motor 110 is joined to an internal surface of the casing 113*a* by shrinkage fitting, etc. Further, the main shaft part 104*a* of the rotary shaft 104 is slidably supported by the main bearing 103 integral with the frame 102 provided upwardly of the motor 110. The auxiliary shaft part 104*c* of this rotary shaft 104 is slidably supported by the auxiliary bearing 111 welded to the auxiliary bearing support leg 112 which is press-fitted and welded to the casing 113*a* downwardly of the motor 110.

The bearing 111 is formed by the spherical bearing 111*a* having a cylindrical inner surface adapted to slidably receive the auxiliary bearing part 104*c* of the rotary shaft 104. The outer ring 111*b* has an inner spherical surface $111b_1$ slidable on the outer spherical surface of the spherical bearing 111*a* and a cylindrical surface $111b_2$, and the inner ring 111*c* has an outer cylindrical surface press-fitted into the inner cylindrical surface $111b_2$ of the outer ring and also an inner spherical surface $111c_1$.

The compressor body 101 is mounted on the frame 102 and composed chiefly of the orbiting scroll 105 and the fixed scroll 106. The boss 105*a* is formed at the central portion of the lower surface of the orbiting scroll 105. The upper eccentric part 104*b* of the rotary shaft 104 is fitted in a recess formed in the boss 105*a*. The orbiting scroll 105 is thereby eccentrically rotated with rotation of the rotary shaft 104. However, the rotation of the orbiting scroll 105 about its axis is prevented by the Oldham's ring 108 provided on the upper surface of the frame 102. The orbiting scroll 105 thus moves on a circular trajectory about the center of the rotary shaft 104. In the following discussion, this movement of the orbiting scroll 105 is referred to as a revolution. The fixed scroll 106 is fixed to the frame 102 with bolts 109. The wraps 105*b* are spirally provided on the upper surface of the orbiting scroll 105. The spiral wrap 106 is also provided on the lower surface of the fixed scroll 160 disposed on the upper portion of the orbiting scroll 105. The wrap 105*b* of the orbiting scroll and the wrap 106*a* of the fixed scroll 106 are thus disposed in meshing engagement with each other. Spiral configurations of the wrap 105*b* and the wrap 106*a* are different from each other. Tips of the spiral centers of the wraps 105*b*, 106*a* contact each other at two points. Wall surfaces of the wraps 105*b*, 106*a* also contact each other at two points. The compression chamber 101*a* is defined by the wall surfaces and the tips of the wraps 105*b*, 106*a* and also the contact points of the wall surfaces thereof. When the orbiting scroll 105 makes a revolution, the contact points of the wall surfaces of the wrap 105*b*, 106*a* move along a path defined by the wraps. The contact of the tips of the wraps 105*b*, 106*a* does not change, and hence the compression chamber 101*a* becomes narrow.

The discharge port 106*b* is provided in the vicinity of the fixed scroll 106. Further, the suction pipe 107 communicates with the compression chamber 101*a* defined by the wraps 105*b* of the orbiting scroll 105 and the wrap 106*a* of the fixed scroll 106. The compressor body 101 is inserted into the casing 113*a* closed by bottom cover member 113*c*. After the center of the compressor body 101 has been aligned with the axis of the casing 113*a*, point welding is effected between the outer peripheral surface of the frame 102 and the inner surface of the casing 113*a* to secure them together.

When the rotary shaft 104 is rotated by the motor 110, as explained earlier, the orbiting scroll 105 makes an orbiting motion of revolution. A volume of the compression chamber 101*a* is gradually reduced with every revolution. During this operation, a refrigerant gas from the evaporator (not shown) in the refrigerating cycle is supplied through the suction pipe 107 to the compression chamber 101*a*. The refrigerant gas is gradually compressed and discharged into the closed container 113 through the discharge port 106*a*. Thereafter, this refrigerant gas is fed to a condenser (not shown) in the refrigerating through a discharge pipe (not shown).

On the other hand, the lubricating oil 114 is maintained in the bottom of the closed container 113. When the rotary shaft 104 rotates, this lubricating oil 114 rises through an oil supply hole bored along the central axis of the rotary shaft 104. The lubricating oil is supplied to the inner surfaces of the main bearing 103 and the auxiliary bearing 111 and further between the eccentric part 104*b* of the rotary shaft 104 and a boss 105*a* of the orbiting scroll 105, to thereby assure a smooth operation of the closed type motor-drive compressor.

Figure 8:
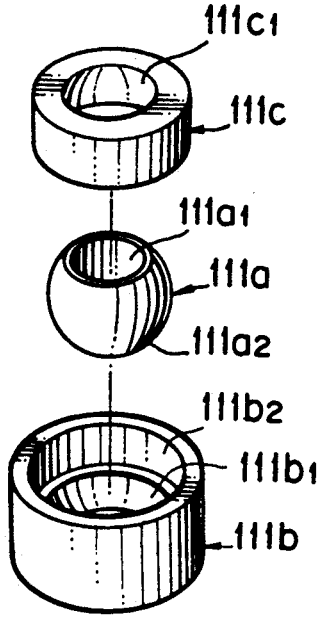
FIG. 8 is an exploded perspective view showing one concrete example of an auxiliary bearing shown in FIG. 7.

The auxiliary bearing 111, as shown most clearly in FIG. 8, includes a spherical bearing 111*a* having the inner surface 111$a_1$ to which the auxiliary bearing part 104*c* (FIG. 7) of the rotary shaft 104 is slidably fitted and an outer surface 111$a_2$ having a spherical shape. The outer ring 111*d*, having an inner spherical surface 111$b_1$, is slidable on the outer spherical surface 111$a_2$ of the spherical bearing 111*a*, and the inner ring 111*c* press-fitted in an annular recess 111$b_2$, with the inner ring 111*c* including an inner spherical surface 111$c_1$ slidable on the outer surface 111$a_2$ of the spherical bearing 111*a*. In assembling the auxiliary bearing, the spherical bearing 111*a* is inserted into the outer ring 111*b* so that the outer spherical surface 111$a_2$ contacts the inner surface 111$b_1$ of the outer ring 111*b*. Thereafter, the inner ring 111*c* is press-fitted into the recess 111$b_2$ to the outer ring 111*b*, whereby the auxiliary bearing 111 is completed as shown in FIG. 7. In this case, however, the outer surface 111$a_2$ of the outer spherical bearing 111*a* is slidable on the inner surface 111$b_1$ of the outer ring 111*b* and on the inner surface 111$c_1$ of the inner ring 111*c*. Hence, the spherical bearing 111*a* is slidably embraced by the respective rings 111*b*, 111*c*. Note that the spherical bearing 111*a* and the rings 111*b*, 111*c* are each made of a steel plate or steel material and formed by plastic working or machining.

Figure 9:
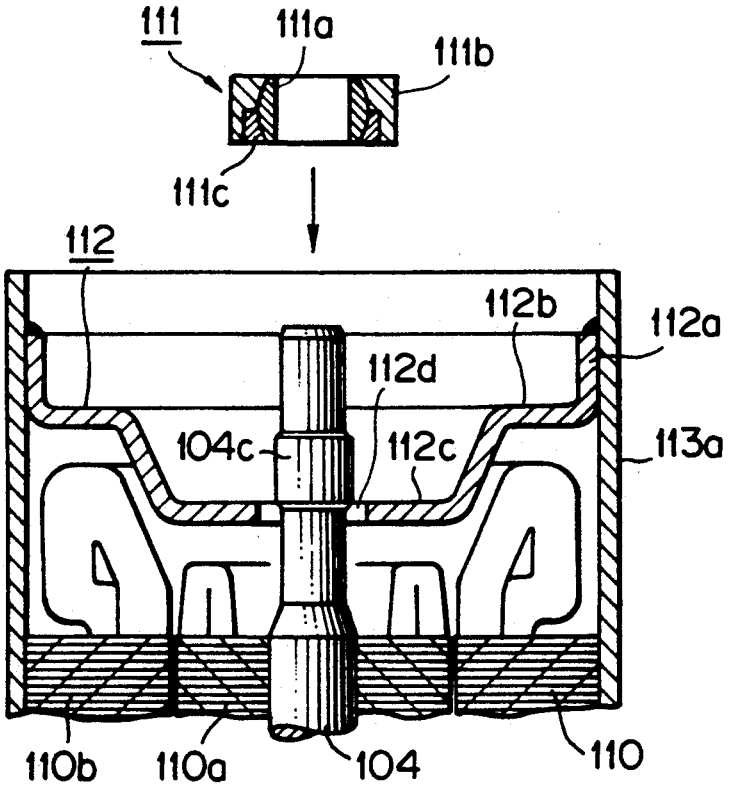
FIG. 9 is a vertical-sectional view of a state where the auxiliary bearing shown in FIG. 7 and support leg therefore are assembled.

FIG. 9 provides an example of an assembly of the support leg 112 and the auxiliary bearing 111. As shown in FIG. 9, the assembly of the support leg 112 includes an annular wall 112*a*, a radially outer radial part 112*b*, a radially inner radial part 112*c* and a hole 112*d*.

The annular wall 112*a* is press-fitted into the casing 113*a* and joined thereto. The outer radial part 112*b* extends from the annular wall 112*a*. The inner radial part 112*c* extends from the inner radial 112*b* in such a manner so as to define a recess to configuration. Formed in the central portion of the inner radial part 112*c* is a hole 112*d* having a diameter greater than a major diameter of the auxiliary bearing part 104*c* of the rotary shaft 104 but less than a major diameter of the outer ring 111*b* of the auxiliary bearing 111. The auxiliary bearing part 104*c* of the rotary shaft 104 is passed through the hole 112*d*. The thus constructed support leg 112 is made of steel plates and shaped by cold plastic working of the steel plate at high accuracy. The support leg 112 can be formed in a short time period. The support leg 112 is secured to the inner surface of the casing 113*a* by press-fitting the annular wall 112*a* of the support leg 112 into the inner surface of the casing 113*a* and thereafter welding the annular wall 112*a* to the inner surface of the casing 113*a*.

The support leg includes the annular wall 112*a* having an area large enough to support the wall 112*a* from the inner surface of the casing 113*a*. It is, therefore easy to stably secure the support leg 112 to the casing 113*a* by press-fitting. Further, the auxiliary bearing 111 is mounted on the support leg 112 at a point more inwardly of the casing 113*a* than the annular wall 112*a* of the support leg 112 welded to the casing 113*a* can be set on this side of the casing 113*a*, thereby facilitating the welding operation.

Figure 10:
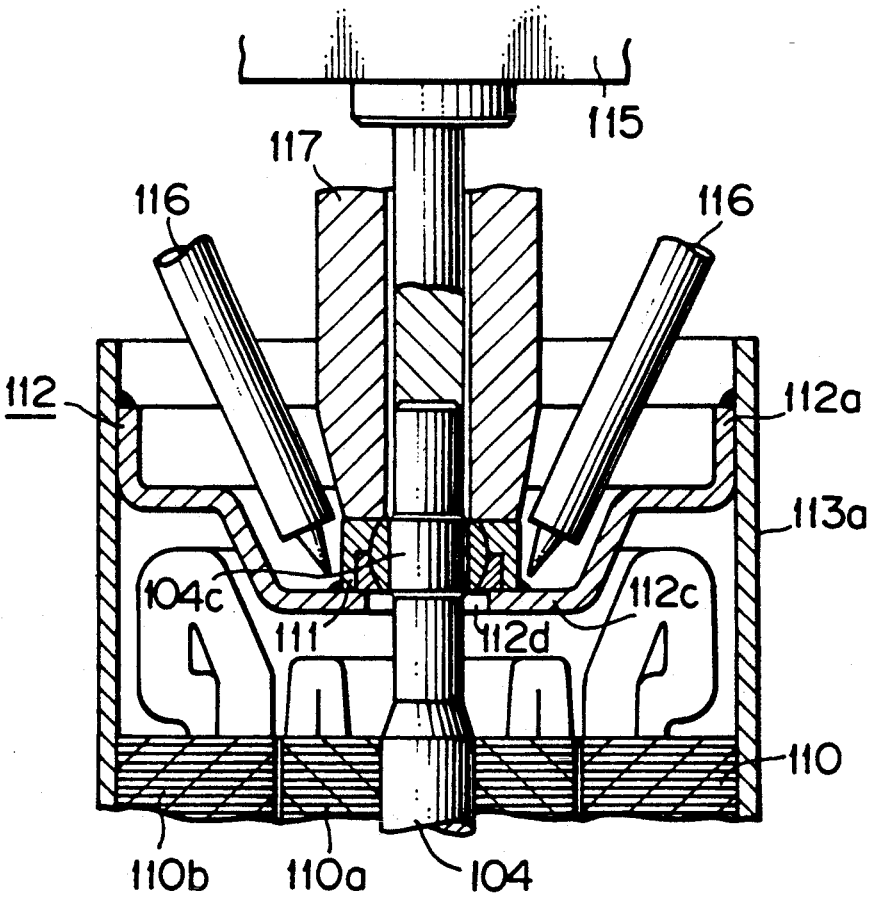
FIG. 10 is a vertical-sectional view showing a method of mounting the auxiliary bearing on the support leg shown in FIG. 9.

In the state shown in FIG. 9, the auxiliary bearing 111 assembled in the above-described manner is attached to the auxiliary bearing part 104*c* of the rotary shaft 104, thus mounting it on the inner radial part 112*b* of the support leg 112. Thereafter, the auxiliary bearing 111 is fixed to the support leg 112 by performing centering and welding operations of the constructive members of the auxiliary bearing 111. This will be explained referring to FIG. 10 wherein the centering device 115 is provided along with a plurality of welding and notches 116, and an auxiliary bearing temporary fixing jig 117.

The auxiliary bearing 111 is received on the auxiliary bearing part 104*c* and mounted on the inner radial part 112*c* of the support leg 112 so that the inner surface 111*a* (FIG. 8) of the spherical bearing 111*a* thereof is slidable on the auxiliary bearing part 104*c* of the rotary shaft 104. Thereafter, the centering device 115 in combination with a rotating torque measuring device or the like performs a centering operation to obtain an optimum clearance between the auxiliary bearing part 104*c* and the inner surface 111*a* of the spherical bearing 111*a* of the auxiliary bearing 111 by rotating the rotary shaft 104 at a low speed while adjusting a position of the auxiliary bearing 111. When the centering operation is finished, the auxiliary bearing temporary fixing jig 117 temporarily fixes the auxiliary bearing 111 by depressing the auxiliary bearing 111 against the inner radial part 112*c* of the support leg 112. Then, point-weldings are effected at a plurality of points overlapped between the support leg 112 and the auxiliary bearing 111 by the plurality of welding torches 116. On this occasion, the welding involves use of non-consumable electrodes which do not use fillers, so that a normal welding state with a relatively small amount of sputtering can be obtained by co-welding.

In this manner, the auxiliary bearing 111 is attached to the support leg 112 in the auxiliary bearing 111, however, as explained in conjunction with FIG. 8, the auxiliary bearing part 104*c* of the rotary shaft 104 is slidable on the inner surface 111$a_1$ of the spherical bearing 111*a*. Additionally, the outer surface 111$a_2$ of the spherical bearing 111*a* is also slidable on the inner surface 111$c_1$ of the inner ring 111*c* as well as on the inner surface 111*b* of the outer ring 111*b*. Consequently, even if the rotary shaft 104 is not straight or true and a bending deformation is caused therein, the eccentricity of the rotary shaft 104 due to the bending deformation can be absorbed by the sliding portions of the bearing 111. Hence, the auxiliary bearing 111 acts as a smooth sliding bearing for the auxiliary bearing part 104*c* of the rotary shaft 104. It is therefore possible to reduce friction therebetween and prevent generation of frictional sounds.

Further, the casing 113*a* is inferior in terms of the accuracy because of its being formed by the steel plate plastic working in view of the costs. When the support leg is fixed by the welding after mounting the compressor body 101, the motor 110 and the rotary shaft 104 in the casing 113*a*, the concentricity of the compressor body 101 with the casing 113*a* is difficult to obtain. The center of the casing 113*a* is offset from the center of the rotary shaft 104. In accordance with the embodiment discussed hereinabove, however, even if the center of the casing 113*a* is offset with respect to the rotary shaft 104, the inner radial part 112*c* of the support leg 112 is formed therein with the hole 112*d* into which the auxiliary bearing 104*c* of the rotary shaft 104 is loosely inserted. The auxiliary bearing 111 is centered in the manner described above with respect to the auxiliary bearing part 104c extending through this hole 112d. Then, the auxiliary bearing 111 is fixed by welding to the support leg 112. The support bearing for the rotary shaft 104 is thereby attainable.

Figure 11:
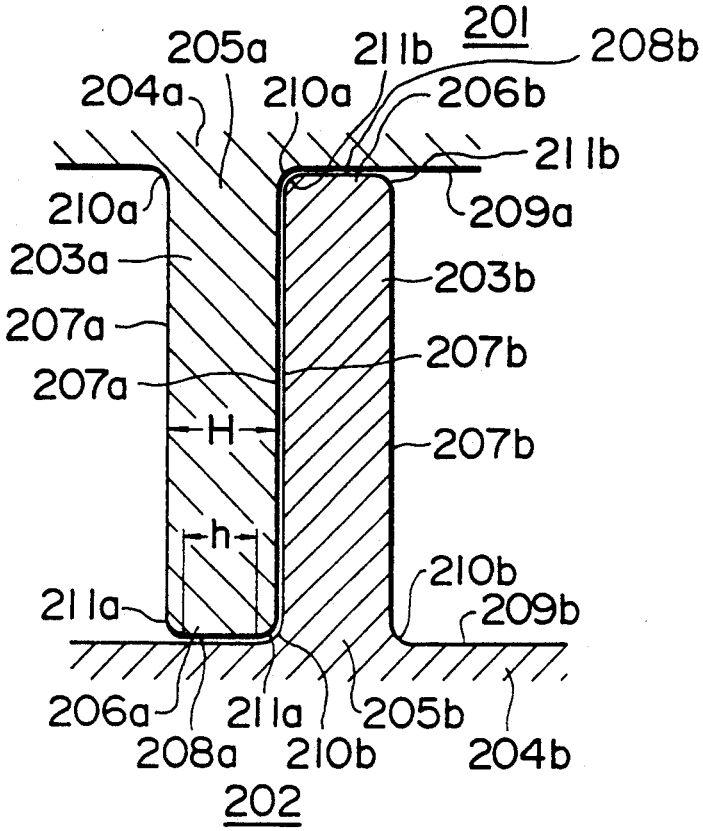
FIG. 11 is a vertical-cross-sectional view illustrating a portion of a still further embodiment of the scroll compressor of this invention.

The scroll compressor of FIG. 11 includes a fixed scroll 201, an orbiting scroll 202, wraps 203a, 203b, end plates 204a, 204b, wrap root parts 205a, 205b, wrap tip parts 206a, 206b, wrap side surfaces 207a, 207b, wrap upper surfaces 208a, 208b, wrap bottom surfaces 209a, 209b, wrap root round-chamfered parts 210a, 210b, and wrap tip round-chamfered parts 211a, 211b.

In FIG. 11, the fixed scroll 201 is disposed above the orbiting scroll 202. The fixed scroll 201 includes the disk-like end plate 204a and the wrap 203a protruding from the wrap bottom surface 209a towards the orbiting scroll 202. The orbiting scroll 202 also includes the disk-like end plate 204b and the wrap 203b protruding from the wrap bottom surface 209b towards the fixed scroll 201. As is well known, though not illustrated herein, the wrap 203a assumes a spiral configuration, the wrap 203b is engaged with the wrap 203a and similarly assumes a spiral configuration.

At the wrap tip part 206a of the wrap 203a, the wrap upper surface 208a thereof is parallel with the wrap bottom surface 209b of the orbiting scroll 202 and is very close thereto. Similarly, at the wrap tip part 206b of the wrap 203b, the wrap upper surface 208b thereof is parallel with the wrap bottom surface 209a of the fixed scroll 201 and is very close thereto. The orbiting scroll 202 orbits about an unillustrated axis with respect to the fixed scroll 201. An interval between the wrap upper surface 208a and the wrap bottom surface 209b is maintained constant irrespective of this orbiting motion. Further, an interval between the wrap side surfaces 207a, 207b confronting the wraps 203a, 203b varies with this orbiting motion. These wrap side surfaces 207a, 207b are, however, always maintained in parallel.

The wrap root round-chamfered parts 210a are formed on both sides of the wrap root part 205a of the wrap 203a protruding from the wrap bottom surface 209a of the fixed scroll 101. Further, the wrap tip round-chamfered parts 211a are also formed on both sides of the wrap tip part 206a. Similarly, the wrap root round-chamfered parts 210b are formed on both sides of the wrap root part 205b of the wrap 203b protruding from the wrap bottom surface 209b of the gyrating scroll 202. Further, the wrap tip round-chamfered part 211b are also formed on both sides of the wrap tip part 206b.

Figure 12:
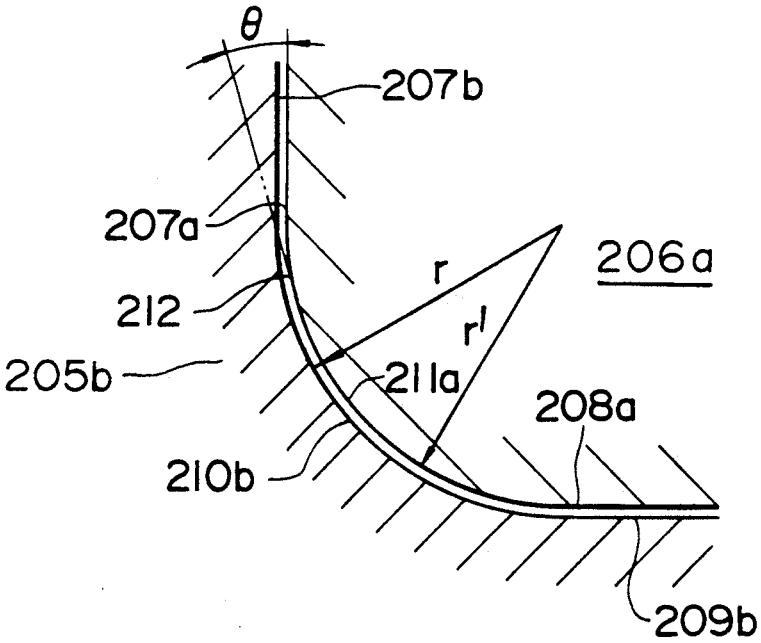
FIG. 12 is an enlarged sectional view of chamfered parts at the tip part and the bottom of the wrap shown in FIG. 11.

FIG. 12 illustrates portions of the wrap tip part 206a of the wrap 203a and the wrap root part 205b and the wrap 203b of FIG. 11.

Referring to FIG. 11, the wrap root round-chamfered part 210b of the wrap 203b forms a part of a circle having a radius r tangent to the wrap side surface 207b and the wrap bottom surface 209b perpendicular thereto. Wrap root round-chamfered part 2210b is thereby smoothly continual to the wrap side surface 207b and the wrap bottom surface 209b. Further the wrap tip round-chamfered part 211a of the wrap 203a forms a part of the circle having a radius r' slightly less than the radius r and concentric with the circle having the radius r. The wrap tip round-chamfered part 211a is thereby smoothly continual to the wrap upper surface 208a. However, a rectilinear part 212, which forms an arbitrary angle $\theta$ of 15° or less to the wrap side surface 207a and is tangent to the wrap tip round-chamfered part 211a, is formed between the wrap side surface 207a and the wrap tip round-chamfered part 211a. This rectilinear part 212 is provided for the purpose of, as will be described later, preventing the occurrence of burr due to extreme steps in cutting when the wraps 203a, 203b are machined. This situation is the same for the wrap root part 205a and the wrap 203a and the wrap tip part 206b of the wrap 203b.

FIG. 13 provides an example of a method of machining the wrap root round-chamfered parts 210a, 210b and the wrap tip root round-chamfered parts 211a, 211b of the wraps 203a, 203b. Hereinafter, as the machining method is conducted for the wraps 203a, 203b, the description will be made by removing the letters a and b from the respective reference numerals.

Figure 13A:
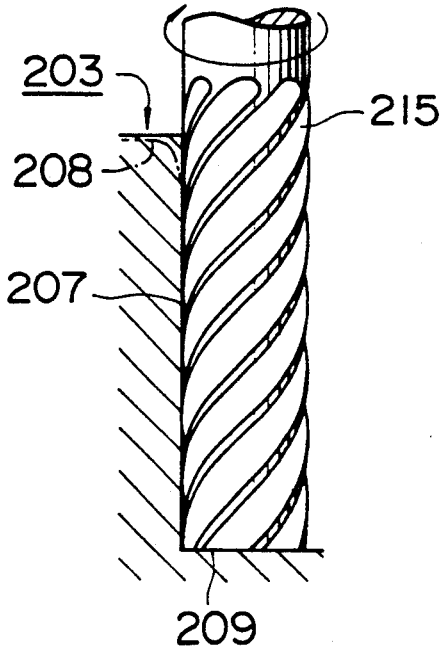
FIGS. 13A, 13B and 13C are vertical sectional views showing an example of a machining process of a wrap.
Figure 13B:
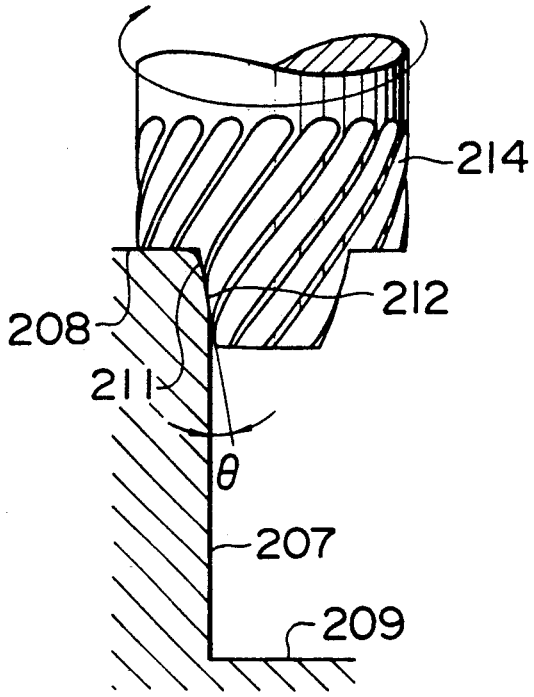

FIG. 13A illustrates a state where a wrap side surface 207 and a wrap bottom surface 209 are simultaneously machined by a roughing end mill 215. A wrap 203, having a thickness slightly greater than a predetermined thickness is thereby formed. FIG. 13B shows a state where the wrap upper surface 208 and the wrap tip round-chamfered part 211 are simultaneously machined by a round-chamfering cutter 214. The round-chamfering cutter 214 has a general configuration having a radius r' and an arbitrary angle $\theta$ with respect to the tangent thereto. The relative wrap rectilinear part 212 is thus thereby formed between the wrap tip round-chamfering part 211 and the wrap side surface 207. The portion of a cutting edge of the round-chamfering cutter 214 which forms the angle $\theta$ with respect to the wrap side surface 207 is longer than the portion of the cutter by which the wrap 203 is actually machined. Hence, there is no step between the formed wrap tip round-chamfered parts 211 and the wrap side surface 207. Besides, the occurrence of burr due to the cutting can be prevented.

Figure 13C:
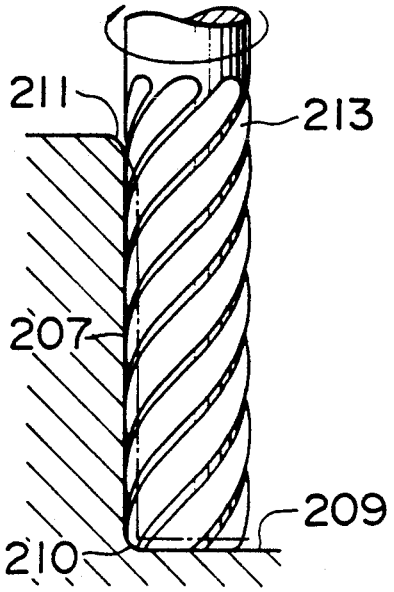

FIG. 13C illustrates a situation where the wrap side surface 207 and the wrap bottom surface 209 are simultaneously machined by a finish machining end mill 213 wherein a circular arc having a radius r corresponding to the wrap root round-chamfered 210 is added to the tip. Removed is the rectilinear part 212 having the angle $\theta$ to the wrap tip round-chamfered part 211 which is formed in the step shown in FIG. 13B. However, if cutting trajectories of the chamfering cutter 214 and the finish machining end mill 213 are slightly different from each other, so rectilinear part 212 is left. However, this is very small and is obtuse-angled to the wrap side surface. This does not therefore cause any adverse effect on the formation of an oil film of refrigerator machine oil.

Figure 23A:
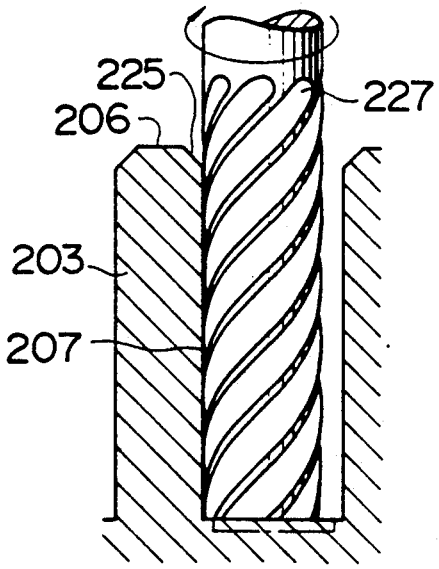
FIG. 23A PRIOR ART
FIGS. 23A and 23B are vertical-sectional views illustrating one example of the machining process of the scroll wrap shown in FIG. 22.
Figure 23B:
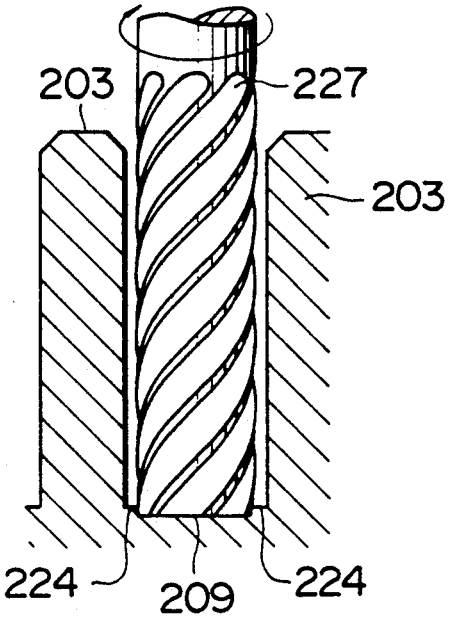
FIG. 23B PRIOR ART
Figure 24A:
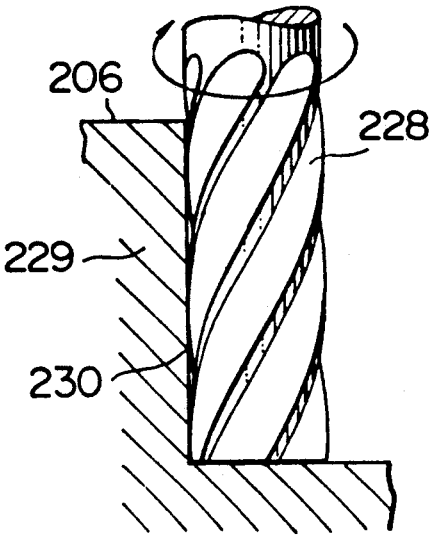
FIG. 24A PRIOR ART
FIGS. 24A and 24B are vertical-sectional views illustrating another example of the conventional machining process of the scroll wrap.
Figure 24B:
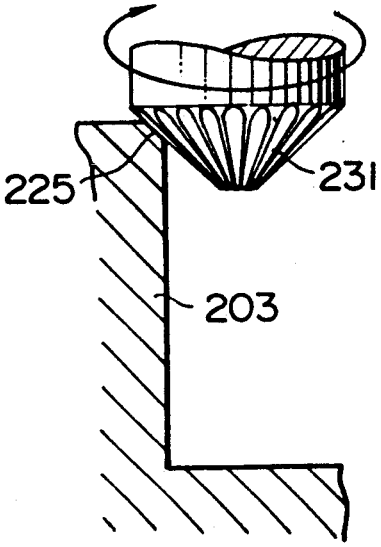
FIG. 24B PRIOR ART
Figure 25A:
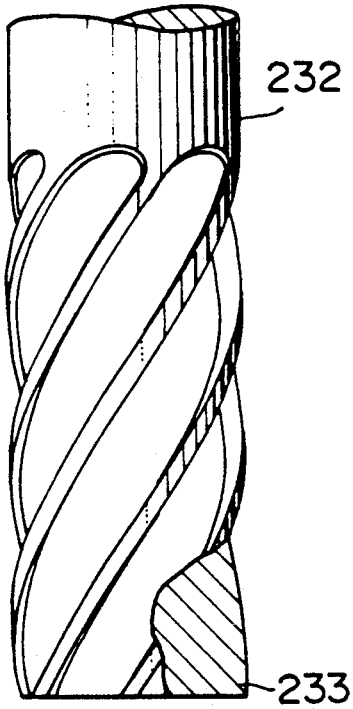
FIG. 25A PRIOR ART
FIGS. 25A and 25B are perspective views showing examples of conventional scroll wrap machining end mills.
Figure 25B:
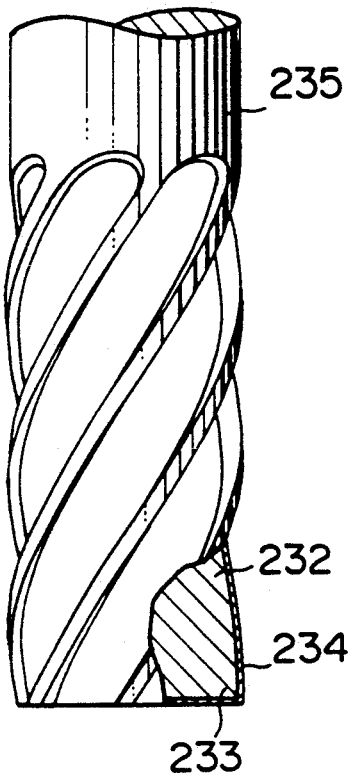
FIG. 25B PRIOR ART

The wrap bottom surface 209 and the side surface 207 are, as illustrated in FIG. 13C, simultaneously machined by the single end mill 213 having the very small circular arc at its tip. Therefore, the finish machining can be performed in a shorter time and the working efficiency is improved more remarkably by the cutting method wherein the stepped portion 224 is formed by separately effecting the respective machining steps as in the case of the conventional method shown in FIG. 23. Further, if the tip of the end mill has an acute angle, chipping (chips) is caused during the cutting process, thereby inevitably causing an imbalance between the working accuracy and the working efficiency. The end mill shown in FIG. 13C, however, has a very small circular arc part at its tip. The occurrence of chipping is thereby avoided. The working accuracy and the working efficiency are also improved.

Figure 14:
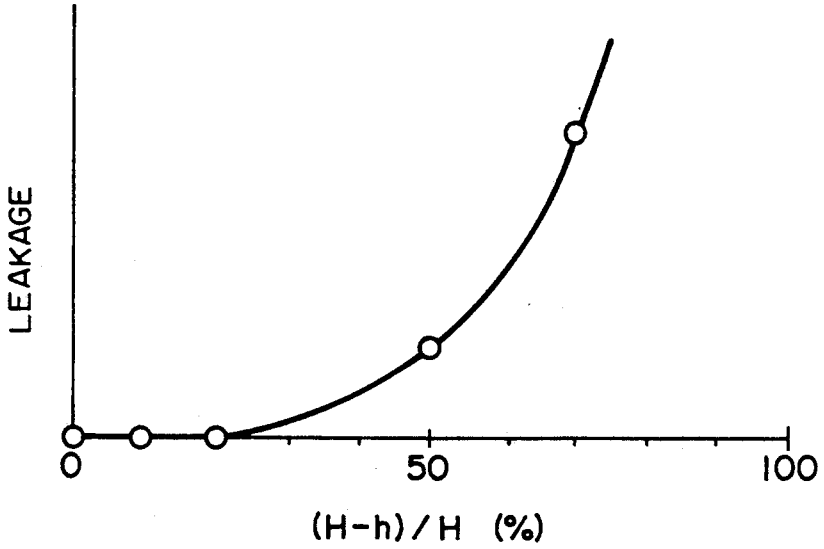
FIG. 14 is a graphical illustration of one example of a relationship between a width of the wrap top surface shown in FIG. 11 and a gas leakage.

Additionally, if the radii r, r' of the wrap root round-chamfered 210 and the wrap tip round-chamfered part 211 are too large for the thickness H of the wrap 203 as shown in FIG. 11, it is impossible to secure a width of plane formed by the wrap upper surface 208 and the wrap bottom surface 209, so that the refrigerant gas leaks from therebetween, resulting in a deterioration of performance of the compressor. More specifically, in a relation between a gas leakage quantity and a virtual plane width h obtained by subtracting the radii r, r' from the wrap thickness H, as illustrated in FIG. 14, the gas leakage quantity increases with a reduction in the dimension h. Then, the radii r, r' are each set to be less than 5° of the wrap thickness H as a result of a test about the wrap thickness of a certain range. This makes it possible to virtually sufficiently reduce the gas leakage by combined action of the oil film of the refrigerator machine oil The performance of the compressor can also be secured well.

Figure 22:
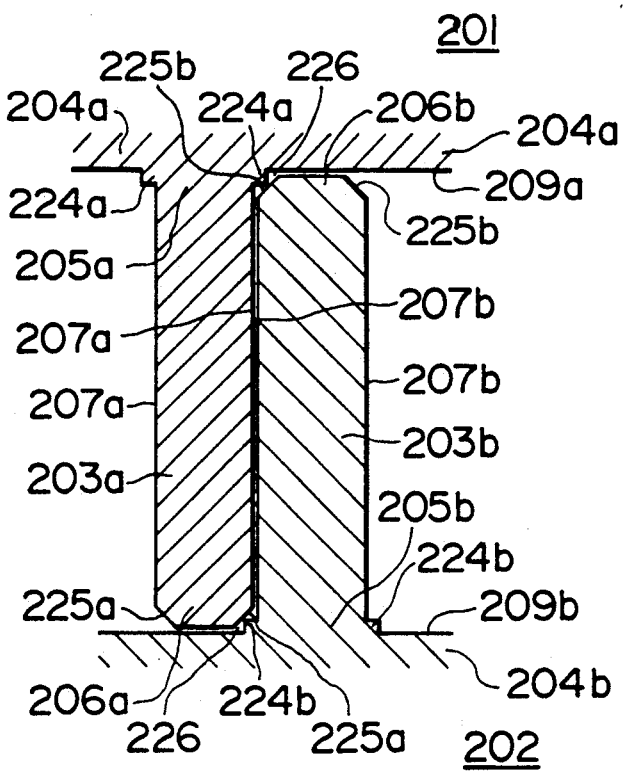
FIG. 22 PRIOR ART
FIG. 22 is a vertical-sectional view showing a portion of one example of a conventional scroll compressor.

As discussed above, in accordance with this embodiment, the wrap 203 is provided with the circular arc wrap root round-chamfered 210, while the wrap tip part 206 is provided with the wrap tip round-chamfered 211, respectively. It is, therefore, possible to reduce the leakage of the refrigerant gas more remarkably while keeping a mechanical strength of the lap 203 at a high level than in the prior art compressor shown in FIG. 22.

Figure 15:
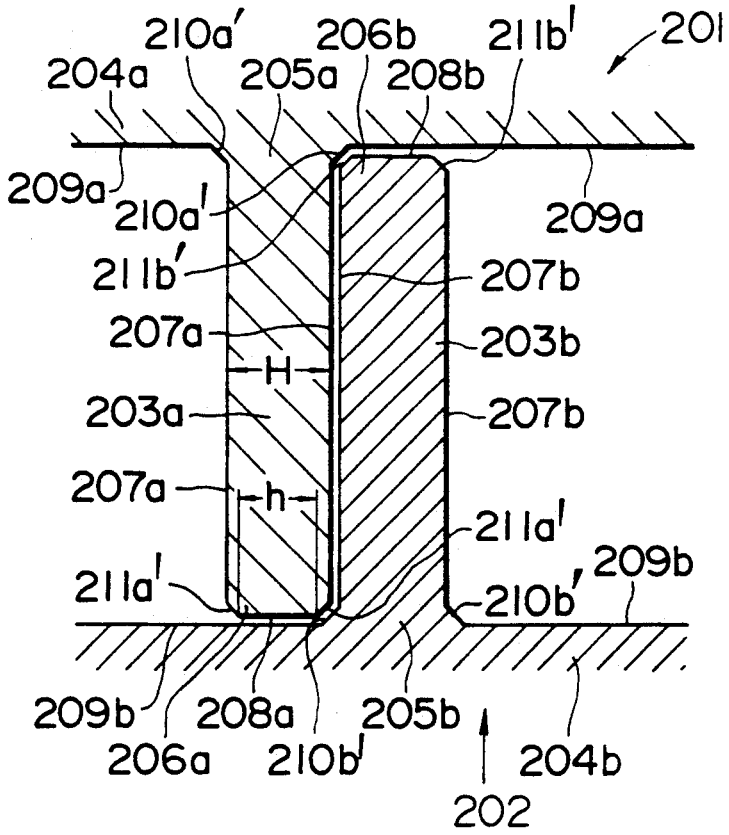
FIG. 15 is a vertical-sectional view illustrating a portion of another embodiment of the scroll compressor of the present invention.

FIG. 15 illustrates a state where the fixed scroll and the orbiting scroll are assembled in a further embodiment of the scroll compressor according to the present invention, wherein the scroll compressor includes wrap root reverse-chamfered parts 210*a*, , 210*b*, , and wrap tip chamfered parts 211*a*', 211*b*'.

Configurations of the chamfered parts in the embodiment of FIG. 15 are different from those in the embodiment of FIG. 11 the features other than this point are the same as those of the embodiment illustrated in FIG. 11.

Referring to FIG. 15, the rectilinear wrap root reverse-chamfered part 210*a*', inclined to an end plate 204*a* is formed in the wrap root part 205*a* of the wrap 203*a* of the fixed scroll 201. The rectilinear wrap tip chamfered part 211*b*' inclined to the wrap side surface 207*b* of the wrap 203*b* and parallel with the wrap root reverse-chamfered part 210*a*' is formed by the wrap tip parts 206*b* of the wrap 203*b* of the orbiting scroll 202. Similarly, the rectilinear wrap root reverse chamfered part 210*b*, inclined to an end plate 204*b* is formed in the wrap root part 205*b* of the wrap 203*a* of the orbiting scroll 202. Formed in the wrap tip part 206*a* of the wrap 203*a* of the fixed scroll 201 is the rectilinear wrap tip chamfered part 211*a*, inclined to the wrap side surface 207*a* of the wrap 203*a* in parallel with the wrap root reverse-chamfered part 210*d*'.

Figure 16:
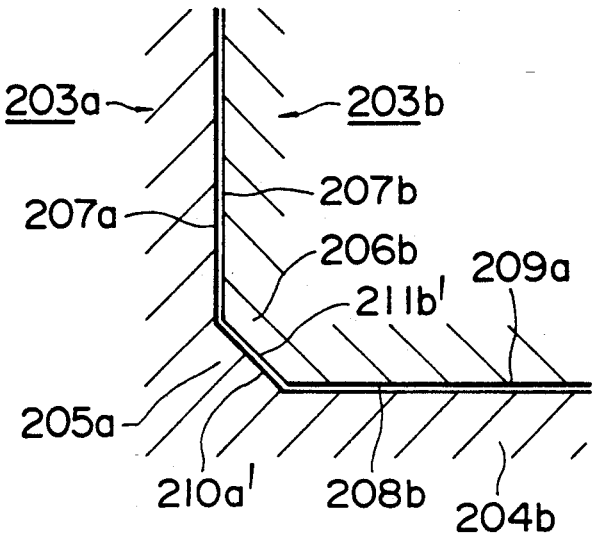
FIG. 16 is an enlarged sectional view illustrating the chamfered parts at the tip part and the bottom of the wraps shown in FIG. 15

FIG. 16 illustrates the wrap root reverse-chamfered part 210' and the wrap tip chamfered part 211, shown in FIG. 16. For the same reason as pointed out above, the explanation will be made by removing the letters a, b from the symbols indicating the respective components. As apparent from the above description, and from FIG. 16, the wrap tip chamfered part 211' is parallel with the wrap root reverse-chamfered part 210. The length of the wrap tip chamfered part 211' in the oblique direction is slightly smaller than the length of the wrap root reverse-chamfered part 210' in the same direction. For this reason, the wraps 203*a*, 203*b* approach each other, an interval between the wrap root reverse-chamfered part 210' and the wrap tip chamfered part 211' is sufficiently small and uniform in its entirety. Hence, as in the embodiment shown in FIG. 11, the oil film of the refrigerator machine oil is easily formed between the wrap root reverse-chamfered part 210' and the wrap tip chamfered part 211'.

Further, in FIG. 15, the virtual plane width h of each of the wrap upper surfaces 208*a*, 208*b* at the wrap tip parts 206*a*, 206*b* of the wraps 203*a*, 203*b* becomes less than the thickness H of each of the wraps 203*a*, 203*b* by providing the wrap tip chamfered parts 211*a*', 211*b*'. The relationship between this virtual plane width h and the gas leakage quantity is established as shown in FIG. 14. The wrap tip chamfered parts 211*a*', 211*b*' and the wrap root reverse-chamfered parts 210*a*', 210*b*' are so formed that a reduction in the virtual plane width h caused by the provision of the wrap tip chamfered parts 211*a*', 211*b*' is set to be less than 5% of the thickness H of each of the wraps 203*a*, 203*b*. As in the embodiment shown in FIG. 11, therefore, the oil films of the refrigerator machine oil are readily formed respectively between the wrap upper surface 208*a* and the wrap bottom surface 209*b* and between the wrap upper surface 208*b* and the wrap bottom surface 209*a*. The leakage of the refrigerant gas can thereby prevented.

Figure 17A:
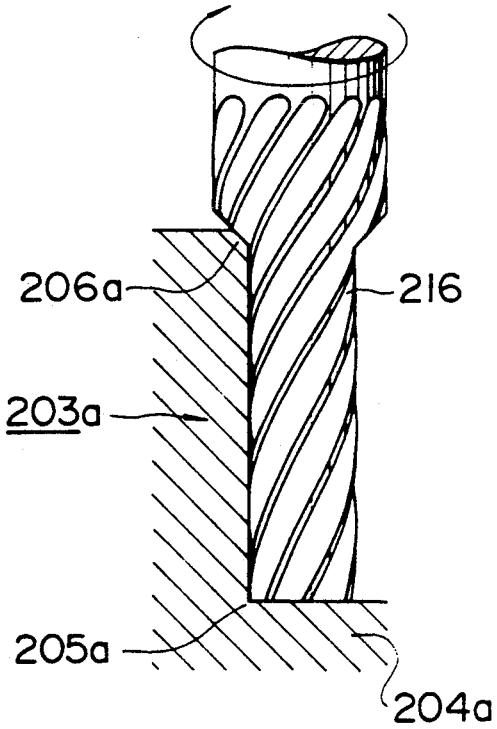
FIGS. 17A and 17B are vertical-sectional views of an example of the machining process of the wrap shown in FIG. 15.

FIG. 17A illustrates one example of how roughing a wrap side surface 207 of the scroll having a machined wrap upper surfaced 208 and the machining of the wrap tip chamfered part 211 of the wrap tip part 206 are carried out by a stepped roughing end mill 216 formed to have an inclined angle.

Figure 17B:
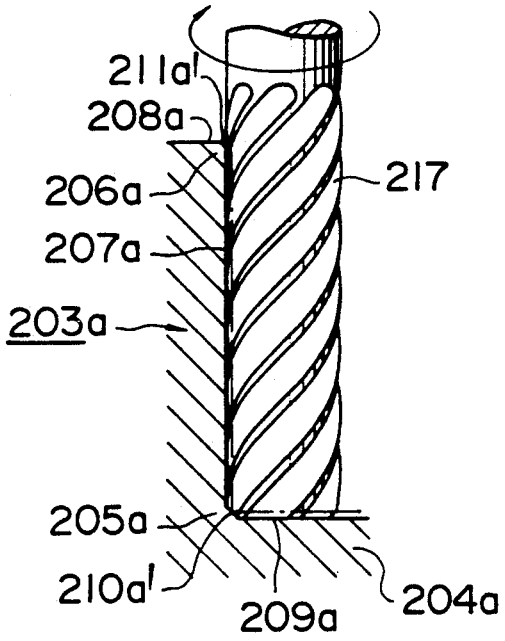

FIG. 17B shows one example of how the wrap tip chamfered part 211 of the wrap tip part 206, the wrap side surface 207 and the wrap root reverse-chamfered part 210 of the wrap root part 205 are machined by use of a finishing end mill 217 having a chamfered tip. In this case, when machining the wrap side surface 207, its cutting allowance is adjusted to have a dimension equal to or slightly smaller than the dimension of the wrap root reverse-chamfered part 210 of the wrap root part 205. Further, the depth of the wrap bottom surface 209 is important with respect to the relative positional relationship with the wrap upper surface 208. A step of measuring the height is interposed between the steps shown in FIGS. 17A and 17B, so that the wrap bottom surface 209 undergoes a finished cutting process.

Also in the above described cutting work, if the tip of the end mill 217 is acute, chipping (chips) is caused between the cutting process, so that an imbalance is caused between the working accuracy and the working efficiency. However, this end mill 217 has the very small rectilinear inclination portion at the tip thereof, thereby avoiding the occurrence of chipping. Improved also are the working accuracy and working efficiency.

As explained earlier, in accordance with this embodiment, the wrap 203 is formed with the rectilinearly inclined wrap root reverse-chamfered part 210, while the wrap tip part 206 is formed with the wrap tip chamfered part 211. Consequently, the leakage of the refrigerant gas can be reduced more remarkably while maintaining the mechanical strength of the wrap 203 at a higher level than in the prior art compressor of FIG. 22.

Figure 18:
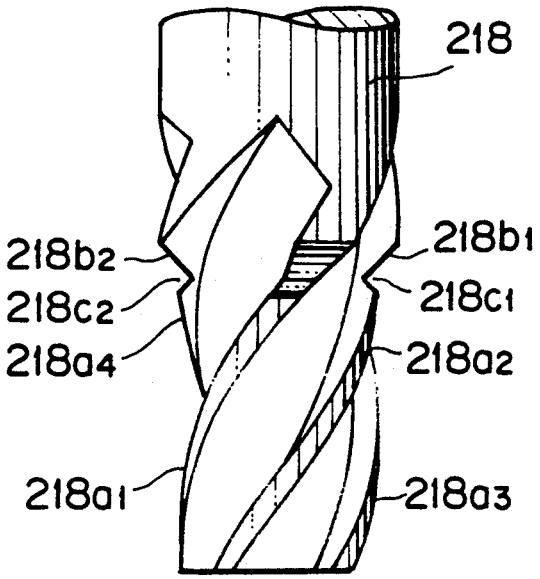
FIG. 18 is a perspective view of one embodiment of a scroll wrap machining end mill of the present invention.

The end mill for machining the scroll wrap as shown in FIG. 18 includes a scroll wrap machining end mill 218, side surface cutting edges 218*a*–218*a*$_4$, chamfering cutting edges 218*b*, 218*b*$_2$, and cutting runoffs 218*c*$_1$, 218*c*$_2$.

Referring to FIG. 18, it is assumed that the scroll wrap machining end mill 218 is provided with four blades of cutting edges. In one of the four blades, the side surface cutting edge 218a2, the chamfering cutting edge 218$b_1$ which utilizes most of a stepped portion and the cutting-runoff 218$c_1$ therebetween are machined at a high accuracy. Cut-machined also at the high accuracy in another blade are the side surface machine cutting edge 218$a_4$, the chamfering cutting edge 218$b_2$ and the cutting run-off 218$c_2$ therebetween. Further, the remaining two cutting edges form the side surface machining cutting edges 218$a_1$, 218$a_3$ in their entirety and have the same dimensions as those of the side surface machine cutting edges 218$a_2$, 218$a_4$. Besides, these remaining cutting edges are so formed so as to extend beyond the chamfering cutting edge 218b and further to the upper part of the chamfering cutting edge of the scroll wrap machining end mill 218.

The blades are provided with the chamfering cutting edges 218$b_1$, 218$b_2$ include the stepped portions disposed at levels higher than other cutting edges at the root part of the scroll wrap machining end mill 218. The chamfering cutting edges 218$b_1$, 218$b_2$ and the cutting run-offs 218$c_1$, 218$c_2$ are shaped at predetermined angles. Note that the cutting blades including the side surface machining cutting edges 218$a_2$, 218$a_4$ and the chamfering cutting edges 218$b_1$, 218$b_2$, each exhibiting different actions, are preferably provided in symmetry with respect to the central axis of the scroll wrap machining end mill 218 in the viewpoint of obtaining stable cutting vibrations and cutting ability as well.

Figure 19A:
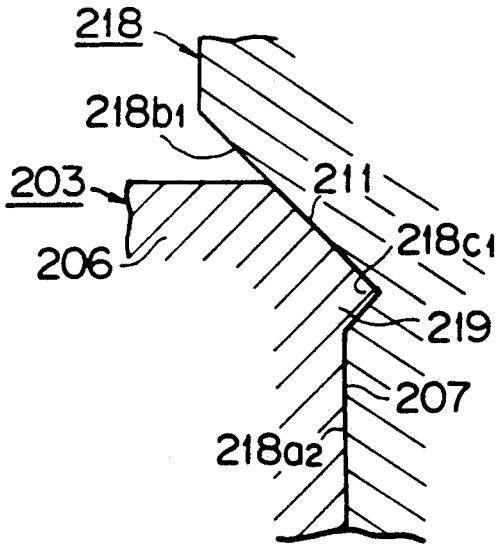
FIGS. 19A and 19B are views showing states where scroll wraps are machined by the embodiment shown in FIG. 18.

FIG. 19A illustrates a state of how the wrap side surface 207 and the chamfered part 211 of the tip part 206 of the wrap 203 are machined by the scroll machining end mill 218 described above.

As illustrated in FIG. 19A, the wrap side surface 207 is machined by the side surface machining edge 218$a_2$ (or the side surface machining edge 218$a_4$) of the scroll wrap machining end mill 218. The end of the wrap tip part 206 is machined by the chamfering cutting edge 218$b_1$ (or the chamfering cutting edge 218$b_2$) of the scroll wrap machining end mill 218, thus forming the chamfered part 211. At this moment, a projection 219 is formed at a boundary between the chamfered part 211 and the wrap side 207 by the recessed cut run-off 218$c_1$ (or the cutting run-off 218$c_2$) of the scroll wrap machining end mill 218.

Figure 19B:
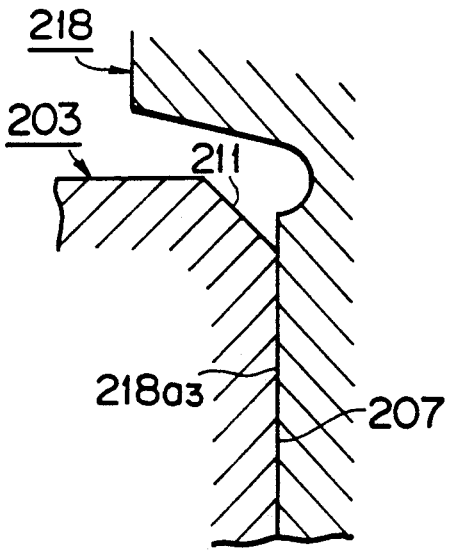

However, as illustrated in FIG. 19B, when the wrap side surface 207 is cut by the succeeding side surface machining edge 218$a_1$ (or the side surface cutting edge 218$a_3$) with rotation of the scroll wrap machining end mill 218, the projection 219 is also cut and removed.

In this manner, according to this embodiment, the wrap side surface 207 and the chamfered part 211 of the tip part 206 of the wrap 203 are simultaneously formed. Besides, a positional relationship of the thus formed chamfer parts 211 of the tip part 206 is determined based on the construction of the scroll wrap machining end mill 218 and is therefore set at a high accuracy. It follows that the configuration and dimension of the chamfered part 211 of the tip part 206 can be set at the high accuracy simply by enhancing an accuracy of positional adjustment of the single scroll wrap machining end mill 218.

In accordance with this embodiment, the chamfering cutting edges 218$b_1$, 218$b_2$ each assume the rectilinearity and are therefore useable for machining the wrap 203 shown in FIG. 15. However, the chamfering cutting edges 218$b_1$, 218$b_2$ are not necessarily rectilinear but may assume arbitrary configurations such as a circular arc, etc.

If the configuration thereof is a circular arc, the cutting edges are useable for machining the wrap 203 shown in FIG. 11.

Figure 20A:
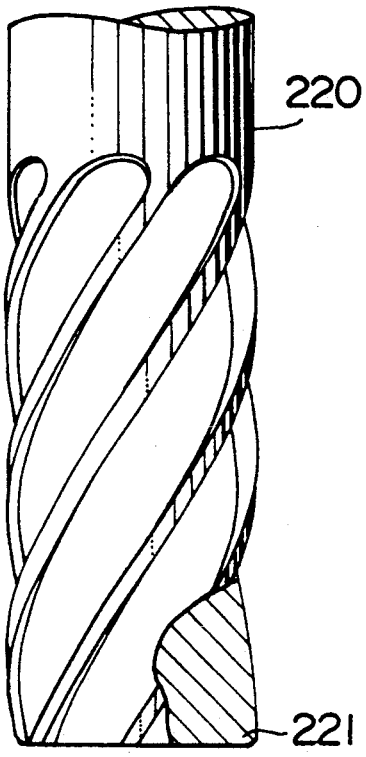
FIGS. 20A and 20B are perspective views of another embodiment of the scroll wrap machining end mill of this invention.
Figure 20B:
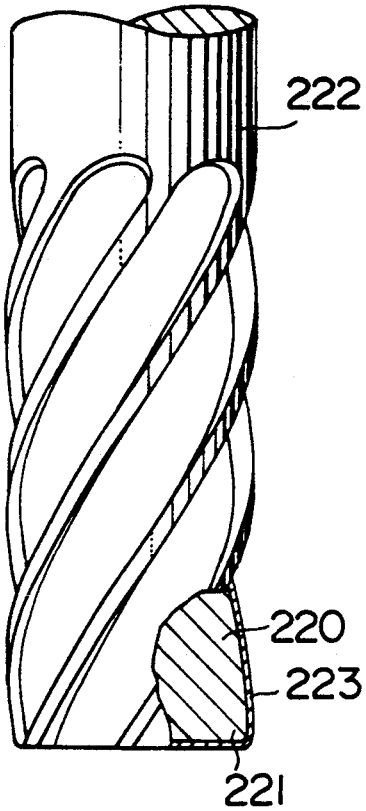

FIGS. 20A and 20B provide an example of a scroll wrap machining end mill according to the present invention including a base metal 220 of the end mill, a cutting edge 221, a coated end mill 222, and a coating 223, with an interior of each end mill being shown by hatching.

Figure 21A:
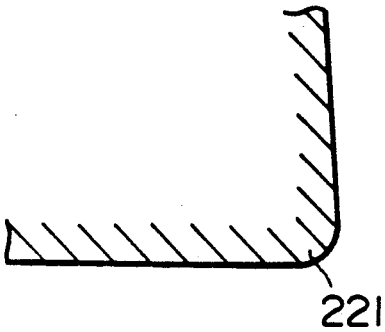
FIGS. 21A and 21B are enlarged sectional views each illustrating a configuration of the tip of the cutting edge shown in FIGS. 20A and 20B.
Figure 21B:
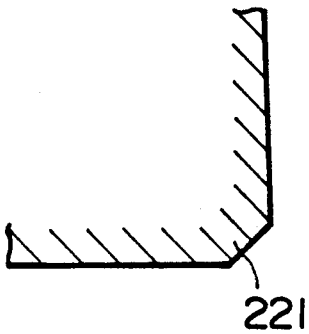

The end mill base 220 (FIG. 20A), as in the case of the conventional scroll lap machining end mill, is made of a tool steel or a super steel material. The end mill is manufactured by the same precision grinding method as the ordinary manufacturing method. However, a substantial difference from the prior art scroll wrap machining end mill resides in a method of forming the cutting edge 221. The end mill base metal 20 is, as shown in FIG. 21A, chamfered in the form of a circular arc or, as shown in FIG. 21B, chamfered rectilinearly, both at the tips of the cutting edges 221.

The coating 223 is, as illustrated in FIG. 20B, applied to the surface of the thus configured end base mill metal. Note that the coating 223 described above is, if not an extreme wall thickness, formed to have a uniform thickness on the surface of the end mill base metal 220. If the coating 223 is extremely thick the accuracy after the coating is remarkably reduced. Further, the strength of the coating itself is greatly lowered to a level at which the coating is not endurable for use with the end mill.

What is claimed is:

1. A closed type motor-driven compressor comprising:

a closed container;

a motor accommodated in said closed container;

a compression means in said container;

a crankshaft for connecting said motor to said compression means, said compression means including a frame disposed in said closed container adjacent said motor and dividing the interior of said closed container into first and second spaces, said compression means having a discharge port through which a mixture of compressed gas and atomized lubricant oil is discharged into said first space, said motor being disposed in said second space, said frame including a bearing portion through which said crankshaft rotatably extends, said frame having formed thereon a passage communicating said first space with said second space adjacent a peripheral wall of said container so that the mixture of the compressed gas and the atomized lubricant oil flows from said first space through said passage into a first zone of said second space radially outwardly remote from said bearing portion of said frame; and a discharge pipe having an inlet positioned in said second space in said closed container and extending outwardly from said closed container to allow the compressed gas to be discharged from said second space, an amount of lubricating oil being contained in a bottom portion of said closed container, wherein a substantially annular shielding member is disposed in said second space between said compression means and said motor and has an axial end connected to said frame of said compression means and extends therefrom into said second space substantially towards said bottom portion of said container to substantially shield a second zone of said second space radially inwardly of said first zone of said second space, said inlet of said discharge pipe is positioned in said second zone of said second space, said passage has an end open to said first zone of said second space whereby a flow of the atomized lubricant oil contained in the mixture flowing from said first space through said passage into said first zone of said second space is minimized from said open end of said passage into said second zone of said second space and thus to said inlet of said discharge pipe.

2. The closed type motor-driven compressor of claim 1, wherein said shielding member is a shielding ring, one end of said shielding ring is connected to said frame, the other axial end of said shielding ring is formed with a portion radially outwardly curled in a flare-like shape, and said flare-like curled portion is disposed in close proximity to a stator coil end of said motor.

3. The closed type motor-driven compressor of claim 2, wherein said shielding ring is made of a material having an electrically insulating property.

4. A closed type motor-driven compressor comprising:

a closed container;

a motor accommodated in said closed container;

a compression means in said container;

a crank shaft for connecting said motor to said compression means; and a discharge pipe having an inlet positioned in said closed container and extending outwardly from said closed container;

an amount of lubricating oil being contained in a bottom portion of said closed container, wherein a shielding member including a cylindrical portion is disposed between said compression means and said motor, said cylindrical portion of said shield member has an axis substantially concentric with an axis of said compression means and extends therefrom towards said bottom portion of said container to define a substantially shielded space, and said inlet of said discharge pipe is positioned in said shielded space, and wherein said motor includes a rotor end ring positioned between said motor and said compression means, said shielding member is a shielding ring, one axial end of said shielding ring is connected to said compression means, the other axial end of said shielding ring is formed with a bottom surface part extending inwards in the radial direction, and said shielding ring bottom surface is disposed in close proximity to said rotor end ring.

5. The closed type motor-driven compressor of claim 1, wherein said motor includes a rotor end ring positioned between said motor and said frame of said compression means, said shielding member is a shielding ring, one axial end of said shielding ring is connected to said frame, the other axial end of said shielding ring is formed with a bottom portion extending radially inwardly toward said bearing portion of said frame, and said shielding rind bottom portion is disposed in close proximity to said rotor end ring.

* * * * *